US011574584B2

(12) United States Patent
Kim et al.

(10) Patent No.: US 11,574,584 B2
(45) Date of Patent: Feb. 7, 2023

(54) DISPLAY DEVICE

(71) Applicant: SAMSUNG DISPLAY CO., LTD., Yongin-si (KR)

(72) Inventors: Soon Dong Kim, Yongin-si (KR); Sang An Kwon, Yongin-si (KR); Jin Wook Yang, Yongin-si (KR); Chang Noh Yoon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/657,807

(22) Filed: Apr. 4, 2022

(65) Prior Publication Data

US 2022/0375400 A1 Nov. 24, 2022

(30) Foreign Application Priority Data

May 24, 2021 (KR) ..... 10-2021-0066447

(51) Int. Cl.
*G09G 3/32* (2016.01)

(52) U.S. Cl.
CPC ..... *G09G 3/32* (2013.01); *G09G 2300/0426* (2013.01); *G09G 2300/0842* (2013.01); *G09G 2310/0278* (2013.01); *G09G 2310/0291* (2013.01); *G09G 2310/061* (2013.01); *G09G 2310/08* (2013.01); *G09G 2320/0271* (2013.01)

(58) Field of Classification Search
CPC ..... G09G 3/32; G09G 2300/0426; G09G 2300/0842; G09G 2310/0278; G09G 2310/0291; G09G 2310/061; G09G 2310/08; G09G 2320/0271
See application file for complete search history.

(56) References Cited

U.S. PATENT DOCUMENTS

2014/0333512 A1* 11/2014 In ..... G09G 3/3233 345/76
2015/0035813 A1* 2/2015 Lei ..... G09G 3/3208 330/261
2019/0056611 A1* 2/2019 Marhefka ..... G06F 3/04883
2020/0312234 A1* 10/2020 Lin ..... G06F 3/0412
2021/0312868 A1* 10/2021 Kim ..... H01L 27/3276
(Continued)

FOREIGN PATENT DOCUMENTS

KR 10-2021-0125657 10/2021
KR 10-2022-0030459 3/2022

*Primary Examiner* — Andrew Sasinowski
(74) *Attorney, Agent, or Firm* — F. Chau & Associates, LLC

(57) ABSTRACT

A display device includes a display panel having first and second display areas. A data driver provides data and bias voltages to data lines. A timing controller controls the data driver and a scan driver based on at least two operation modes. The first mode drives the first and second display areas at a normal frequency, and the second mode drives the first display area at a first frequency substantially equal to or lower than the normal frequency and the second display area at a second frequency lower than the first frequency. The second mode includes an active frame to write a reference voltage to display a black image in the second display area, and blank frames to maintain the reference voltage and apply the bias voltage to the pixels in the second display area. The data driver varies the bias voltage in the blank frames.

20 Claims, 16 Drawing Sheets

(56) References Cited

U.S. PATENT DOCUMENTS

| | | | | |
|---|---|---|---|---|
| 2021/0319733 | A1 | 10/2021 | Kim et al. | |
| 2021/0327350 | A1* | 10/2021 | Nam | G09G 3/3233 |
| 2022/0068220 | A1 | 3/2022 | Kim et al. | |

* cited by examiner

SCAN: SCAN[1], SCAN[2], SCAN[3], SCAN[4], SCAN[5], SCAN[6], SCAN[7]

SCAN: SCAN[1], SCAN[2], SCAN[3], SCAN[4], SCAN[5], SCAN[6], SCAN[7]

DISPLAY DEVICE

CROSS-REFERENCE TO RELATED APPLICATION

This application claims priority under 35 U.S.C. § 119 to Korean Patent Application No. 10-2021-0066447, filed in the Korean Intellectual Property Office on May 24, 2021, the entire contents of which are incorporated by reference herein.

1. FIELD OF THE DISCLOSURE

One or more embodiments described herein relate to a display device.

2. DESCRIPTION OF THE RELATED ART

A display device includes one or more driver circuits to drive a display panel. For example, a scan driver may sequentially provide a scan signal to scan lines, and a data driver may provide data signals to data lines. As a result, pixels of the display panel emit light with luminances based on the data signals and the scan signal.

In some cases, to reduce power consumption, the display device may be controlled to display only an image of some frames or may only drive part of the display panel. This may adversely affect performance. For example, when a moving image is displayed on only a partial area of the display panel and a black image is displayed on the remaining areas, deviations in the threshold voltages of pixel transistors may occur. In some cases, this deviation may occur due to differences in stress applied to the pixel driving transistors in various areas. Since a difference in luminance may occur between the areas, it may be visually recognized by a user as an afterimage when an image is displayed on the entire (or a portion of an) area or a portion of the display panel.

SUMMARY

One or more embodiments described herein provide a display device which exhibits improved performance in terms of display quality and/or other operational aspects.

These or other embodiments provide a display device capable of reducing or preventing afterimage from occurring in an area, such as, but not limited to, an area where a black image is displayed on a display panel.

In accordance with one or more embodiments, a display device includes a display panel including pixels connected to data lines and scan lines, respectively, and including a first display area and a second display area adjacent to the first display area; a data driver configured to provide a data voltage and a bias voltage to each of the data lines; a scan driver configured to provide a scan signal to the scan lines; and a timing controller configured to receive input image data and a control signal and control the data driver and the scan driver according to at least two operation modes. The at least two operation modes include a first mode to drive the first display area and the second display area at a normal frequency, and a second mode to drive the first display area at a first frequency substantially equal to or lower than the normal frequency and to drive the second display area at a second frequency lower than the first frequency. The second mode includes an active frame to write a reference voltage to display a black image in the second display area, and blank frames to maintain the reference voltage and apply the bias voltage to the pixels included in the second display area. The data driver is configured to vary and provide the bias voltage in the blank frames.

Solutions of the embodiments are not limited to the solutions described herein. Other solutions that are not mentioned will be clearly understood by those skilled in the art to which the embodiments pertain from the present specification and the accompanying drawings.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF THE ILLUSTRATED EMBODIMENTS

Figure 1:
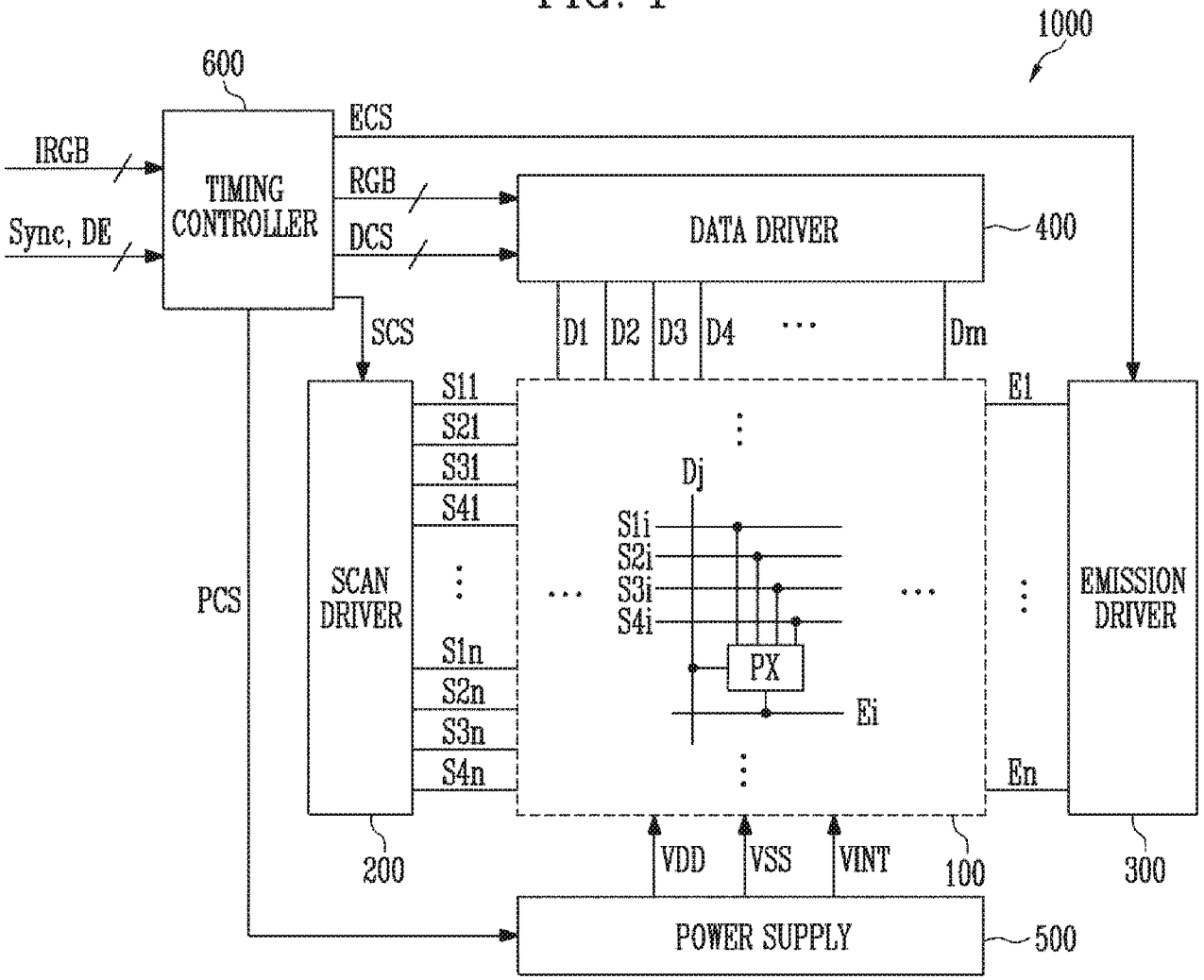
FIG. 1 illustrates an embodiment of a display device.

Terms used in the present specification have been selected from general terms that are currently widely used in consideration of functions of embodiments of the present invention. However, this may vary according to the intention or custom of a person skilled in the art to which embodiments of the present invention pertains, or the emergence of new technologies. However, unlike this, when a specific term is defined and used in an arbitrary meaning, the meaning of the term will be separately described. Therefore, the terms used in the present specification should be interpreted based on the actual meanings of the terms and contents throughout the present specification, not the names of the terms. The drawings attached to the present specification are for easily explaining embodiments of the present invention. Shapes of the components shown in the drawings may be exaggerated and displayed to aid understanding. Therefore, the embodiments are not to be limited by the drawings.

FIG. 1 is a perspective view schematically illustrating a display device 1000 according to an embodiment, and FIG.

2 is a plan view schematically illustrating a scan driver of the display device of FIG. 1 according to an embodiment.

Referring to FIG. 1, the display device 1000 may include a display panel 100, a scan driver 200, an emission driver 300, a data driver 400, a power supply 500, and a timing controller 600. The display panel 100 may include scan lines S11 to S1*n*, S21 to S2*n*, S31 to S3*n*, and S41 to S4*n*, emission control lines E1 to En, data lines D1 to Dm, and pixels PX connected to the scan lines S11 to S1*n*, S21 to S2*n*, S31 to S3*n*, and S41 to S4*n*, the emission control lines E1 to En, and the data lines D1 to Dm, where m and n may be integers greater than 1.

Each of the pixels PX may include a driving transistor and a plurality of switching transistors. The pixels PX may receive voltages of a first driving power source VDD, a second driving power source VSS, and an initialization power source VINT from the power supply 500. Each of the pixels PX may receive a data signal (data voltage) or a bias voltage through the data lines D1 to Dm. According to an embodiment, a pixel PX may receive the data signal (data voltage) through the data lines D1 to Dm in an active frame of a first mode and a second mode, embodiments of which are described below, for example, with reference to FIG. 3. The pixel PX may also receive the bias voltage through the data lines D1 to Dm in blank frames of the second mode. In the embodiment of the present invention, signal lines connected to the pixel PX may be set in various ways to correspond to a circuit structure of the pixel PX.

The timing controller 600 may receive input image data IRGB and control signals Sync and DE from a host system (e.g., an application processor (AP)) through a predetermined interface. The timing controller 600 may generate a first control signal SCS, a second control signal ECS, a third control signal DCS, and a fourth control signal PCS based on the input image data IRGB, a synchronization signal Sync (for example, a vertical synchronization signal, a horizontal synchronization signal, and/or other signals), a data enable signal DE, a clock signal, and the like. The first control signal SCS may be supplied to the scan driver 200, the second control signal ECS may be supplied to the emission driver 300, the third control signal DCS may be supplied to the data driver 400, and the fourth control signal PCS may be supplied to the power supply 500. The timing controller 600 may rearrange the input image data IRGB and supply the rearranged input image data IRGB to the data driver 400.

The timing controller 600 may determine whether to operate in the first mode or the second mode based on the input image data IRGB. In one embodiment, the first mode and the second mode may be operation modes of the timing controller 600 (or the display device 1000). Embodiments of the first mode and the second mode are described below, for example, with reference to FIG. 3.

The timing controller 600 may control the data driver 400 so that the data signal is supplied to the data lines D1 to Dm in the active frame of the first mode and the second mode, and the bias voltage is supplied to the data lines D1 to Dm in the blank frames of the second mode based on the third control signal DCS.

The scan driver 200 may receive the first control signal SCS from the timing controller 600 and may respectively supply a first scan signal, a second scan signal, a third scan signal, and a fourth scan signal to first scan lines S11 to S1*n*, second scan lines S21 to S2*n*, third scan lines S31 to S3*n*, and fourth scan lines S41 to S4*n* based on the first control signal SCS.

The first to fourth scan signals may be set to a gate-on voltage (for example, a low logical voltage) corresponding to the type of transistor to which corresponding scan signals are supplied. The transistor receiving the scan signal may be set to a turned-on state when the scan signal is supplied. For example, the gate-on voltage of the scan signal supplied to a P-channel metal oxide semiconductor (PMOS) transistor may be at a logic low level, and the gate-on voltage of the scan signal supplied to an N-channel metal oxide semiconductor (NMOS) transistor may be at a logic high level. In one embodiment, when a scan signal is supplied, it may be understood that the scan signal is supplied at a logic level that turns on a transistor to be controlled.

The emission driver 300 may supply an emission control signal to the emission control lines E1 to En based on the second control signal ECS. For example, the emission control signal may be sequentially supplied to the emission control lines E1 to En. The emission control signal may be set to a gate-off voltage (for example, a high logical voltage). A transistor receiving the emission control signal may be turned off when the emission control signal is supplied and may be set to a turned-on state in other cases. In one embodiment, supplying an emission control signal may be understood as supplying the emission control signal at a logic level that turns off a transistor to be controlled.

In FIG. 1, for convenience of explanation, the scan driver 200 and the emission driver 300 are shown as separate components, but these drivers may be combined (e.g., on a printed circuit board or in a chip) in another embodiment. According to one embodiment, the scan driver 200 may include a plurality of scan drivers that respectively supply at least one of the first to fourth scan signals. In addition, in one embodiment at least a portion of the scan driver 200 and the emission driver 300 may be integrated into one driving circuit, module, or the like.

The data driver 400 may receive the third control signal DCS and image data RGB from the timing controller 600. The data driver 400 may convert the image data RGB in a digital format into an analog data signal (data voltage).

The data driver 400 may supply the data signal (e.g., the data voltage) or the bias voltage to the data lines D1 to Dm in response to the third control signal DCS. The data signal (e.g., the data voltage) or the bias voltage supplied to the data lines D1 to Dm may be supplied to be synchronized with the first scan signal supplied to the first scan lines S11 to S1*n*. In this case, the bias voltage may form a bias state in a source electrode and/or a drain electrode of the driving transistor in the pixel PX. The bias voltage may be, for example, a positive voltage. However, the level of the bias voltage is not limited thereto, and the bias voltage may be a negative voltage in another embodiment.

The power supply 500 may supply a voltage of the first driving power source VDD and a voltage of the second driving power source VSS for driving the pixel PX to the display panel 100. A voltage level of the second driving power source VSS may be different from (e.g., lower than) a voltage level of the first driving power source VDD. For example, the voltage of the first driving power source VDD may be a positive voltage, and the voltage of the second driving power source VSS may be a negative voltage.

The power supply 500 may supply a voltage of the initialization power source VINT to the display panel 100. The initialization power source VINT may include initialization power sources (for example, VINT1 and VINT2 shown in FIG. 5) output at different voltage levels. The initialization power source VINT may be a power source for initializing the pixel PX. For example, the driving transistor and/or a light emitting element included in the pixel PX may be initialized by the voltage of the initialization power source VINT. The initialization power source VINT may be, for example, a negative voltage.

Figure 2:
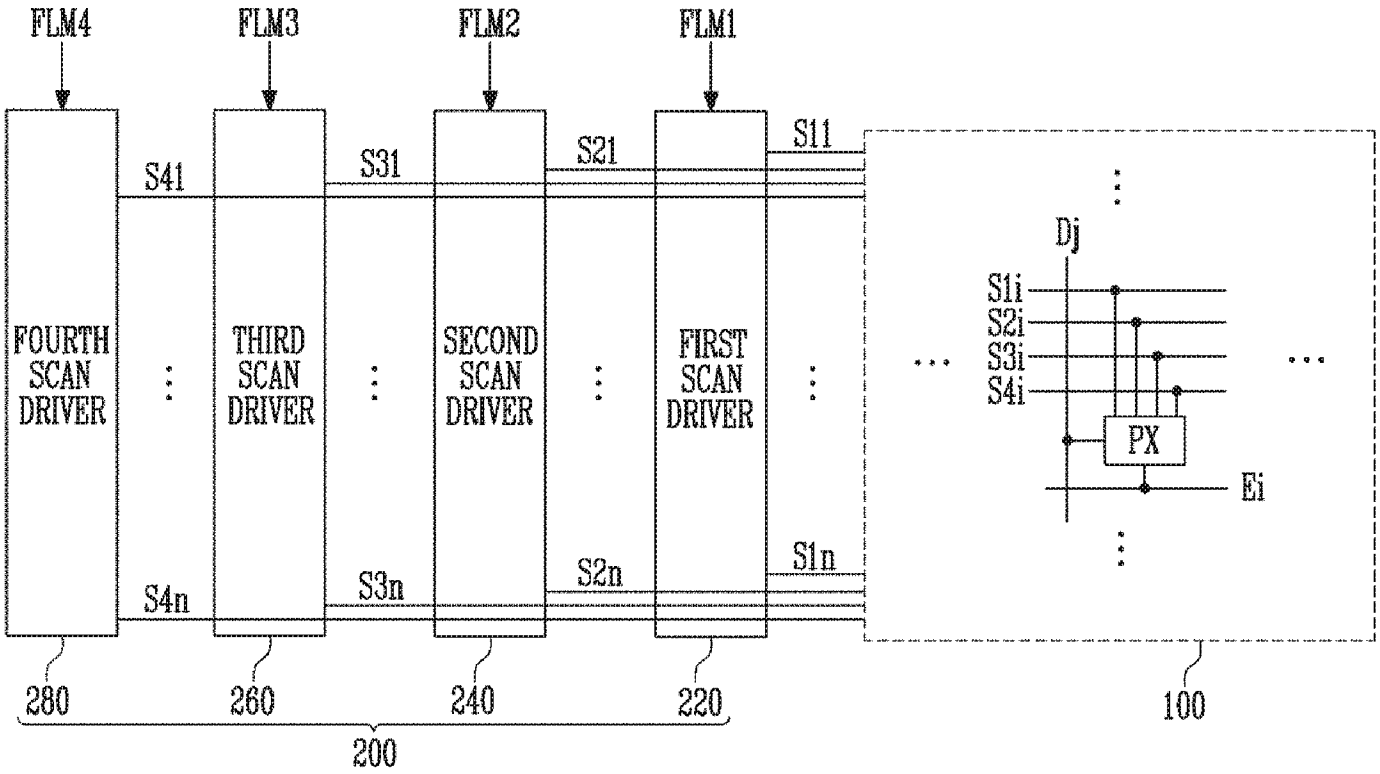
FIG. 2 illustrates an embodiment of a scan driver.

FIG. 2 is a diagram illustrating an embodiment of the scan driver 200 in the display device of FIG. 1. Referring to FIGS. 1 and 2, the scan driver 200 may include a first scan driver 220, a second scan driver 240, a third scan driver 260, and a fourth scan driver 280.

The first control signal SCS may include first to fourth scan start signals FLM1 to FLM4. The first to fourth scan start signals FLM1 to FLM4 may be supplied to the first to fourth scan drivers 220, 240, 260, and 280, respectively. Widths and supply timings of the first to fourth scan start signals FLM1 to FLM4 may be determined, for example, according to a driving condition of the pixel PX and a frame frequency. The first to fourth scan signals may be output based on the first to fourth scan start signals FLM1 to FLM4, respectively. For example, the signal width of at least one of the first to fourth scan signals may be different from the signal width of the others.

The first scan driver 220 may sequentially supply the first scan signal to the first scan lines S11 to S1*n* in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3. The fourth scan driver 280 may sequentially supply the fourth scan signal to the fourth scan lines S41 to S4*n* in response to the fourth scan start signal FLM4.

Figure 3:
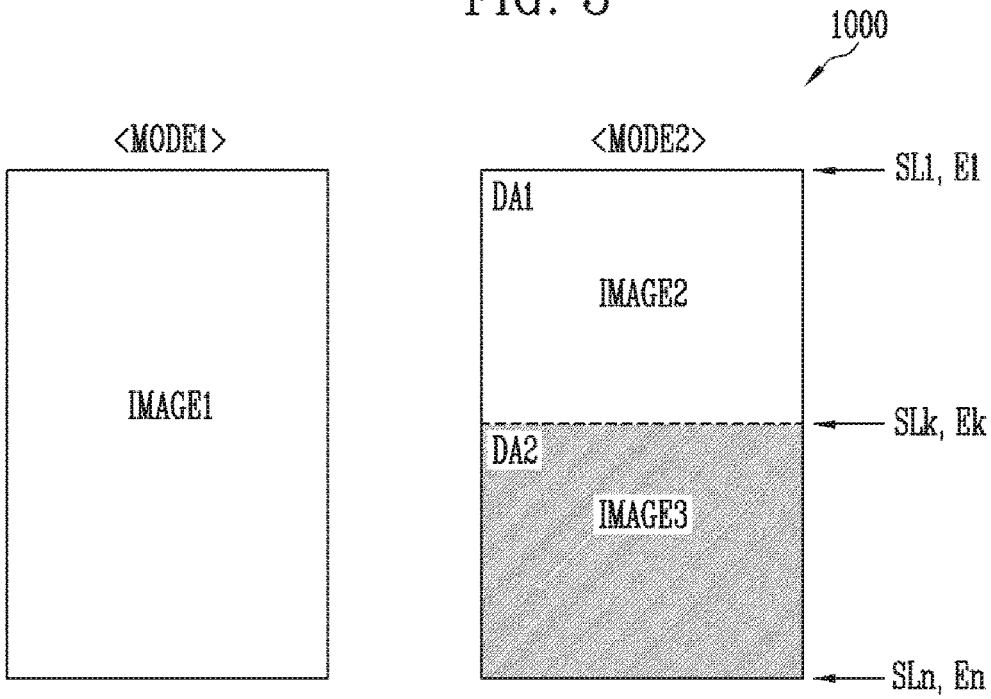
FIG. 3 illustrates an embodiment of driving modes of a display device.
Figure 4A:
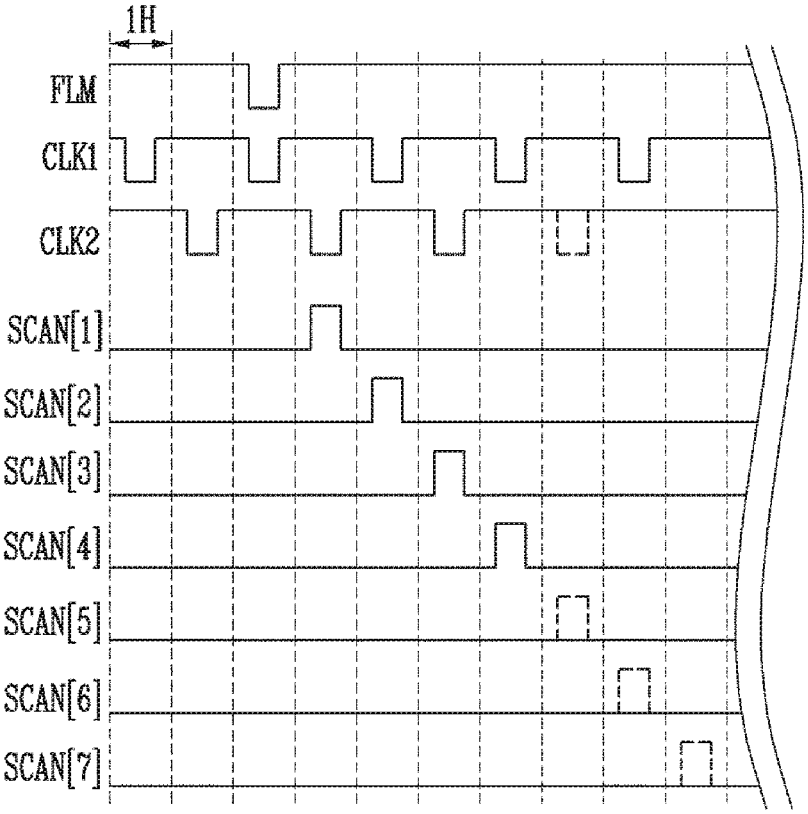
FIGS. 4A and 4B illustrate example waveforms for a masking operation of a scan driver.
Figure 4B:
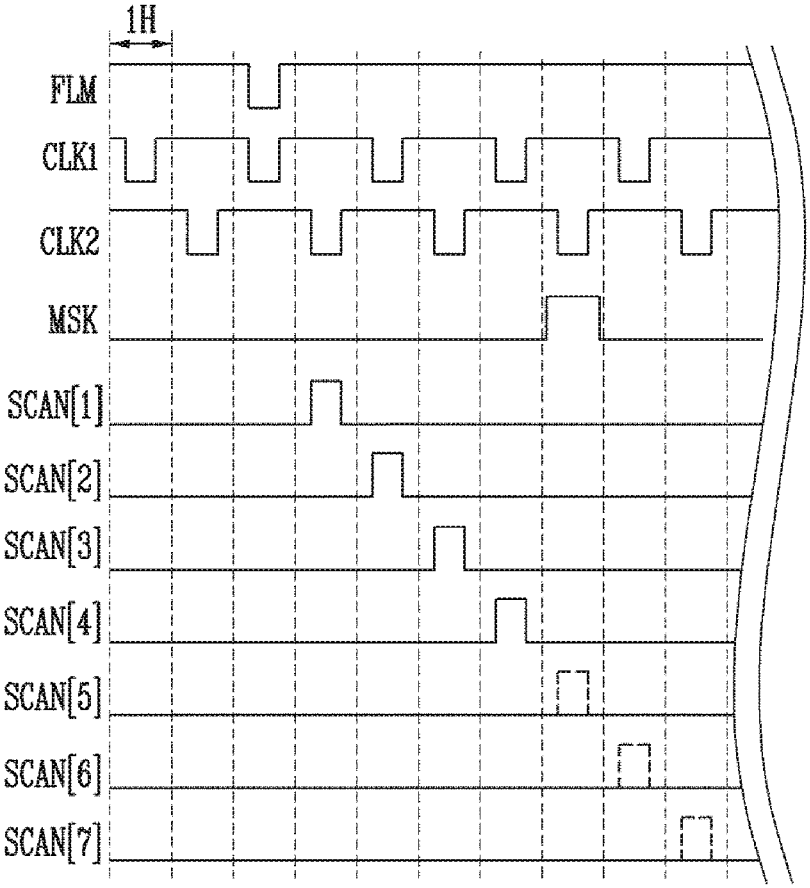

FIG. 3 is a diagram illustrating an embodiment of driving modes of the display device of FIG. 1. FIGS. 4A and 4B are waveform diagrams for explaining an embodiment of a masking operation of a scan driver in a second mode.

Referring to FIGS. 1 and 3, the display device 1000 may operate differently according to the operation mode. The operation mode may include a first mode MODE1 and a second mode MODE2. The first mode MODE1 may be a normal mode. In the first mode MODE1, the display device 1000 may display a first image IMAGE1 corresponding to the entire (or a portion of) display panel 100. The second mode MODE2 may be a partial driving mode. In the second mode MODE2, the display device 1000 may display a second image IMAGE2 (for example, a moving image) in a first display area DA1 of the display panel 100, and display a third image IMAGES (for example, a still image or a low-frequency image) or not display an image in a second display area DA2 of the display panel 100.

According to an embodiment, the display device 1000 may set the driving frequency to a normal frequency (for example, 120 Hz) during the first mode MODEL Accordingly, the display device 1000 may drive both the first display area DA1 and the second display area DA2 at the normal frequency. During the second mode MODE2, the display device 1000 may drive the first display area DA1, in which the second image IMAGE2 is displayed at a first frequency equal to or lower than the normal frequency (for example, 120 Hz, 118 Hz, 110 Hz, 102 Hz, 90 Hz, or 80 Hz), and may drive the second display area DA2 in which the third image IMAGES is displayed at a second frequency lower than the first frequency (for example, 1 Hz, 2 Hz, 10 Hz, 18 Hz, 30 Hz, or 40 Hz). Accordingly, to display the first image IMAGE1 on the entire (or a portion of) display panel 100 in the first mode MODE1, the timing controller 600 may control the scan driver 200, the data driver 400, and the emission driver 300 to operate normally.

In contrast, to display the second image IMAGE2 only in the first display area DA1 of the display panel 100 in the second mode MODE2, the timing controller 600 may control the scan driver 200, the data driver 400, and the emission driver 300 to operate partially. For example, according to the control of the timing controller 600, a scan signal may be provided only to a scan line SL1 (for example, S11, S21, S31, and S41) connected to a first pixel row corresponding to the first display area DA1 to a scan line connected to a (k−1)th pixel row (where k may be a positive integer), and a scan signal (that is, GC[i], GI[i], or GB[i], see FIG. 5) may not be provided to a scan line SLk connected to a k-th pixel row to scan lines SLn (for example, S2*n*, S3*n*, and S4*n*) connected to an n-th pixel row. However, a first scan signal GW[i] (see FIG. 5) may be provided to the first scan lines S11 to S1*n* among the scan line SLk connected to the k-th pixel row to the scan lines SLn connected to the n-th pixel row to provide the bias voltage to the pixel PX.

The first display area DA1 and the second display area DA2 may be fixed, but the present invention is not limited thereto. For example, when the display device 1000 is implemented as a foldable display device, the first display area DA1 and the second display area DA2 may be divided based on a folding axis and may be preset. In another example, when the display device 1000 is implemented as a rollable (or slideable) display device and displays the moving image (corresponding to the first display area DA1) and a black image (corresponding to the second display area DA2), the sizes of the first and second display areas DA1 and DA2 (or the boundary between the first and second display areas DA1 and DA2, a value of k) may vary.

According to an embodiment, the timing controller 600 may divide the display panel 100 into the first display area DA1 and the second display area DA2 based on the input image data IRGB, and may output at least one masking signal indicating the start of the second display area DA2. The at least one masking signal may be included in the first control signal SCS.

Referring to FIGS. 1, 2, 3, and 4A, the timing controller 600 may mask at least one of pulses included in scan clock signals CLK1 or CLK2 in a part of one frame section. In one embodiment, one frame section may be a section displaying one frame image. A part of the one frame section may correspond to a time point at which the scan signal is supplied to the scan line SLk connected to the k-th pixel row or a section including the aforementioned.

For example, the scan clock signals CLK1 and CLK2 may have a first voltage level (for example, a turn-off voltage level that turns off a switching element or transistor, a logic high level) and a pulse waveform periodically transitioned to a second voltage level (for example, a turn-on voltage level that turns on the switching element or transistor, a logic low level). The timing controller 600 may skip the transition of the scan clock signals CLK1 and CLK2 to the second voltage level in the part of the one frame section. For example, the scan clock signals CLK1 and CLK2 may have pulses periodically having the turn-on voltage level. The timing controller 600 may mask, remove, or skip at least one pulse of the scan clock signals CLK1 and CLK2 in the part of the one frame section. Accordingly, the scan clock signals CLK1 and CLK2 may have the first voltage level instead of the second voltage level in the part of the one frame section. In this case, a second scan clock signal CLK2 may be a signal in which a first scan clock signal CLK1 is shifted by one horizontal time 1H (or a half cycle of the first scan clock signal CLK1).

FIG. 4A shows an embodiment in which one pulse of the second scan clock signal CLK2 is masked. In this case, the scan driver 200 may sequentially output a scan signal SCAN in the form of a pulse having the first voltage level (for example, the turn-on voltage level that turns on the switching element or transistor, the logic high level, GC[i] shown in FIG. 5) before the part of the one frame section, and may output the scan signal SCAN having only the second voltage level (for example, the turn-off voltage level that turns off the switching element or transistor, the logic low level, GC[i] shown in FIG. 5) in the part of the one frame section (and after the part of the one frame section). Accordingly, only pixels within a partial area of the display panel 100 (e.g., an area corresponding to a section before the part of the one frame section) may be selected.

By performing only a partial masking operation for the scan clock signals CLK1 and CLK2 by the timing controller 600, the scan signal SCAN (e.g., the scan signal in the form of the pulse having the first voltage level) may be applied to only some of the scan line SL1 connected to the first pixel row to a scan line SLn connected to the n-th pixel row. Accordingly, the display device 1000 may partially drive the display panel 100 and therefore reduce power consumption without adding a separate circuit configuration.

FIG. 4B shows additional waveforms, where the timing controller 600 may apply the scan signal (e.g., the scan signal in the form of the pulse having the first voltage level) to only some of the scan line SL1 connected to the first pixel row to the scan line SLn connected to the n-th pixel row. This may be accomplished by providing a separate masking signal MSK in the part of the one frame section. In this case, the scan clock signals CLK1 and CLK2 may maintain the pulse waveform that has the first voltage level (for example, the turn-off voltage level that turns off the switching element or transistor, the logic high level) and periodically transitioned to the second voltage level (for example, the turn-on voltage level that turns on the switching element or transistor, the logic low level).

Figure 5:
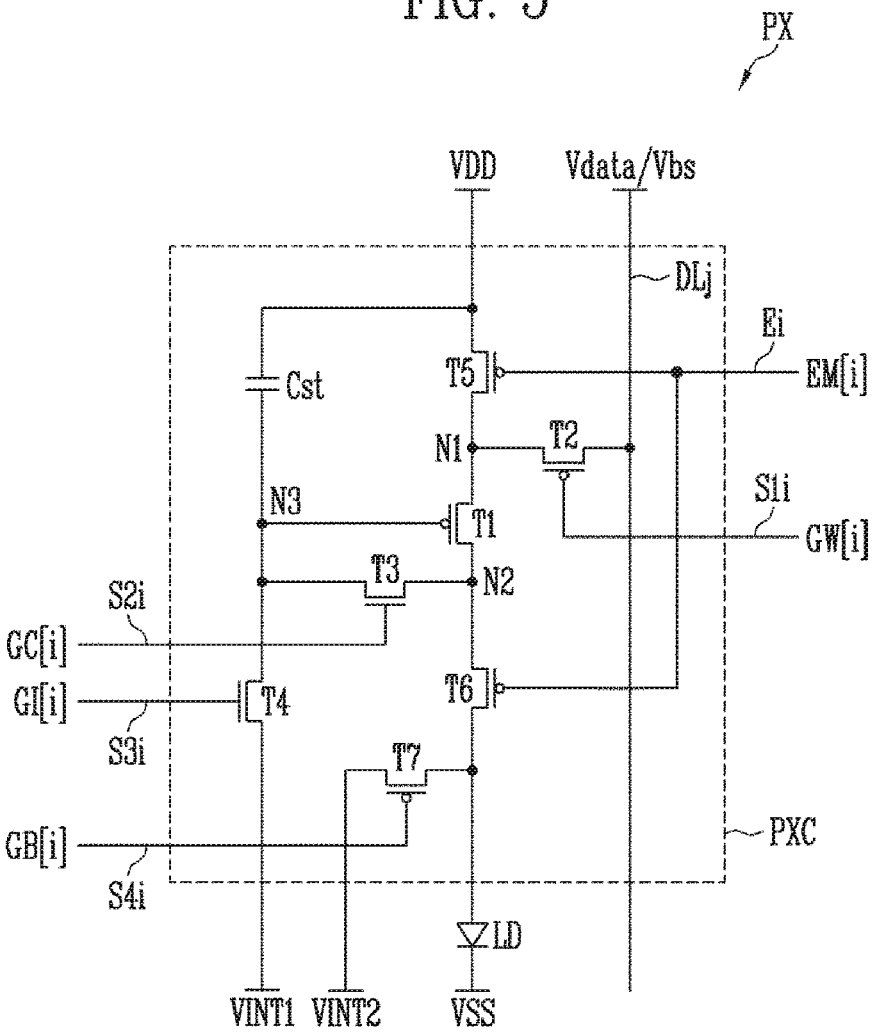
FIG. 5 illustrates an embodiment of a pixel.

FIG. 5 is a circuit diagram illustrating an embodiment of a pixel PX in the display device of FIG. 1. In this case, the pixel PX may be a pixel may be representative of pixels in the display device and therefore is shown as disposed in an i-th row and a j-th column, where i and j are natural numbers.

Referring to FIGS. 1 to 5, the pixel PX may include a light emitting element LD and a pixel circuit PXC connected to the light emitting element LD. An anode electrode of the light emitting element LD may be connected to the pixel circuit PXC, and a cathode electrode may be connected to the second driving power source VSS. The light emitting element LD may generate light having a predetermined luminance in response to the amount of current supplied from the pixel circuit PXC. In an embodiment, the light emitting element LD may be a light emitting element including an organic light emitting layer. In another embodiment, the light emitting element LD may be an inorganic light emitting element formed of an inorganic material. In another embodiment, the light emitting element LD may be a light emitting element which includes a combination of an inorganic material and an organic material. In one embodiment, the light emitting element LD may include a plurality of inorganic light emitting elements connected in parallel and/or in series between the second driving power source VSS and a sixth transistor T6.

The pixel circuit PXC may control the amount of current flowing from the first driving power source VDD to the second driving power source VSS via the light emitting element LD in response to a data voltage Vdata. To this end, the pixel circuit PXC may include first to seventh transistors T1 to T7 and a storage capacitor Cst.

The first transistor T1 may include a first electrode (or source electrode) coupled to a first node N1 (which is electrically connected to the first driving power source VDD) and a second electrode (or drain electrode) coupled to a second node N2 (which is electrically connected to the anode electrode of the light emitting element LD). The first transistor T1 may generate and provide a driving current to the light emitting element LD. A gate electrode of the first transistor T1 may be coupled to a third node N3. The first transistor T1 may function as the driving transistor of the pixel PX.

The second transistor T2 may include a first electrode coupled to a j-th data line DLj, a second electrode coupled to the first node N1, and a gate electrode receiving the first scan signal GW[i]. In this case, when the second transistor T2 is turned on in the active frame of the first mode MODE1 and the second mode MODE2, the data voltage Vdata may be supplied to the first node N1. When the second transistor T2 is turned on in a blank frame of the second mode MODE2, a bias voltage Vbs may be supplied to the first node N1.

The third transistor T3 may include a first electrode coupled to the second node N2, a second electrode coupled to the third node N3, and a gate electrode receiving a second scan signal GC[i]. The third transistor T3 may be turned on by the second scan signal GC[i] to electrically connect the second electrode of the first transistor T1 and the third node N3. Accordingly, when the third transistor T3 is turned on, the first transistor T1 may be connected in diode form. Thus, the third transistor T3 may serve to write the data voltage Vdata for the first transistor T1 and compensate a threshold voltage.

The storage capacitor Cst may be connected between the first driving power source VDD and the third node N3. The storage capacitor Cst may store a voltage corresponding to the data voltage Vdata and the threshold voltage of the first transistor T1.

The fourth transistor T4 may include a first electrode coupled to the third node N3, a second electrode coupled to a first initialization power source VINT1, and a gate electrode receiving a third scan signal GI[i]. The fourth transistor T4 may be turned on when the third scan signal GI[i] is supplied to supply a voltage of the first initialization power source VINT1 to the third node N3. Accordingly, a voltage of the third node N3 (e.g., a gate voltage of the first transistor T1) may be initialized to the voltage of the first initialization power source VINT1. In an embodiment, the first initialization power source VINT1 may be set to a voltage different from (e.g., lower than) the lowest voltage of the data voltage Vdata.

The fifth transistor T5 may include a first electrode coupled to the first driving power source VDD, a second electrode coupled to the first node N1, and a gate electrode receiving an emission control signal EM[i].

The sixth transistor T6 may include a first electrode coupled to the second node N2, a second electrode coupled to the anode electrode of the light emitting element LD, and a gate electrode receiving the emission control signal EM[i]. The fifth and sixth transistors T5 and T6 may be turned on during a gate-on period of the emission control signal EM[i] and may be turned off during a gate-off period.

The seventh transistor T7 may include a first electrode coupled to the anode electrode of the light emitting element LD, a second electrode coupled to a second initialization power source VINT2, and a gate electrode receiving a fourth scan signal GB[i]. The seventh transistor T7 may be turned on when the fourth scan signal GB[i] is supplied to supply a voltage of the second initialization power source VINT2 to the anode electrode of the light emitting element LD. Additionally, the scan lines connected to the transistors T2, T3, T4, and T7 may be different in other embodiments. For example, in one embodiment the seventh transistor T7 may be connected to a (1i−1)th scan line GW[i−1] or a (1i+1)th scan line GW[i+1] to be driven.

In an embodiment, the first, second, fifth, sixth, and seventh transistors T1, T2, T5, T6, and T7 may be P-type LTPS (Low-Temperature Poly-Silicon) thin film transistors, and the third and fourth transistors T3 and T4 may be an N-type oxide semiconductor thin film transistors. Since the N-type oxide semiconductor thin film transistor has better current leakage characteristics than the P-type LTPS thin film transistor, the third and fourth transistors T3 and T4 (serving as switching transistors) may be N-type oxide semiconductor thin film transistors.

Accordingly, leakage current in the third and fourth transistors T3 and T4 may be greatly reduced, and the pixel may be driven at a low frequency (e.g., less than 30 Hz) for purposes of displaying an image. This may, in turn, reduce power consumption in a low power driving mode. In the above description, only the third and fourth transistors T3 and T4 are described as being formed of the N-type oxide semiconductor thin film transistor, but one or more other transistors may be N-type oxide semiconductor thin film transistors in other embodiments.

Figure 6:
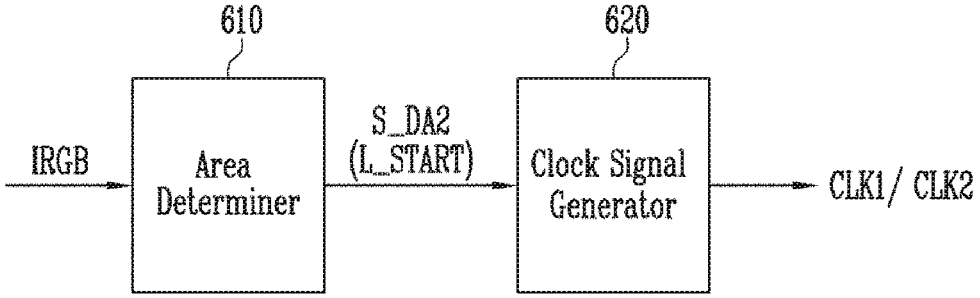
FIG. 6 illustrates an embodiment of a timing controller.

FIG. 6 is a block diagram illustrating an embodiment of the timing controller 600 included in the display device of FIG. 1. Referring to FIGS. 1, 2, and 6, the timing controller 600 may include an area determiner 610 and a clock signal generator 620. Each of the area determiner 610 and the clock signal generator 620 may be implemented as a logic circuit.

The area determiner 610 may determine the second display area DA2, in which a still image or a black image is displayed, by comparing current frame data and previous frame data included in the input image data IRGB. For example, the area determiner 610 may perform a difference operation between the current frame data and the previous frame data, and determine the second display area DA2 as an area in which the result of the difference operation is equal to or less than a reference value. The area determiner 610 may generate information S_DA2 on the second display area DA2 or information L_START on a start line of the second display area DA2 (for example, information on the scan line SLk connected to the k-th pixel row).

The clock signal generator 620 may generate the scan clock signals CLK1 and CLK2, but may mask at least one pulse of the clock signals CLK1 and CLK2 based on the information S_DA2 on the second display area DA2 (or the information on the start line L_START). Referring to FIG. 4A, for example, the clock signal generator 620 may mask the second scan clock signal CLK2 that generates a scan signal SCAN[5] provided to the scan line connected to a fifth pixel row. As described above, the timing controller 600 may selectively drive only some of the scan lines (e.g., of the scan line SL1 connected to the first pixel row to the scan line SLn connected to the n-th pixel row and pixels PX corresponding thereto) by adjusting only a time point at which at least one of the scan clock signals CLK1 or CLK2 is masked.

Figure 7:
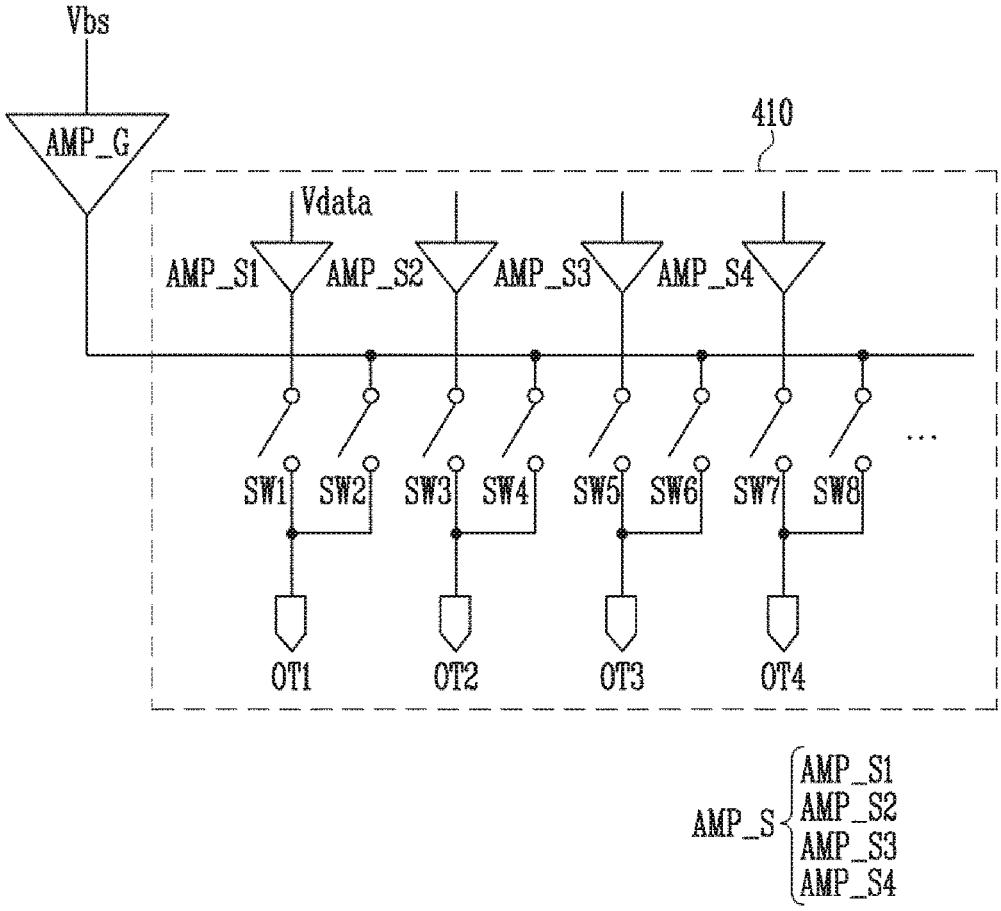
FIG. 7 illustrates an embodiment of an output buffer.

FIG. 7 is a circuit diagram illustrating an embodiment of an output buffer included in the data driver 400 of FIG. 1.

Referring to FIGS. 1 and 7, the data driver 400 may include an output buffer 410 and a common buffer AMP_G. The output buffer 410 may include source buffers AMP_S1, AMP_S2, AMP_S3, and AMP_S4 and switches SW1 to SW8. The first source buffer AMP_S1 may be connected to a first output terminal OT1 through a first switch SW1. For example, the first output terminal OT1 may be connected to a first data line DLL A second switch SW2 may be connected between an output terminal of the common buffer AMP_G and the first output terminal OT1.

Similarly, the second source buffer AMP_S2 may be connected to a second output terminal OT2 through a third switch SW3. For example, the second output terminal OT2 may be connected to a second data line DL2 (e.g., see FIG. 1). A fourth switch SW4 may be connected between the output terminal of the common buffer AMP_G and the second output terminal OT2.

The third source buffer AMP_S3 may be connected to a third output terminal OT3 through a fifth switch SW5. For example, the third output terminal OT3 may be connected to a third data line DL3. A sixth switch SW6 may be connected between the output terminal of the common buffer AMP_G and the third output terminal OT3.

The fourth source buffer AMP_S4 may be connected to a fourth output terminal OT4 through a seventh switch SW7. For example, the fourth output terminal OT4 may be connected to a fourth data line DL4. An eighth switch SW8 may be connected between the output terminal of the common buffer AMP_G and the fourth output terminal OT4.

The switches SW1, SW3, SW5, and SW7 disposed between the source buffers AMP_S1, AMP_S2, AMP_S3, and AMP_S4 and the output terminals OT1, OT2, OT3 and OT4, and the switches SW2, SW4, SW6, and SW8 disposed between the common buffer AMP_P and the output terminals OT1, OT2, OT3 and OT4, may operate alternatively. For example, when the switches SW1, SW3, SW5, and SW7 disposed between the source buffers AMP_S1, AMP_S2, AMP_S3, and AMP_S4 and the output terminals OT1, OT2, OT3, and OT4 are turned on, the switches SW2, SW4, SW6, and SW8 disposed between the common buffer AMP_P and the output terminals OT1, OT2, OT3, and OT4 may be turned off. When the switches SW1, SW3, SW5, and SW7 disposed between the source buffers AMP_S1, AMP_S2, AMP_S3, and AMP_S4 and the output terminals OT1, OT2, OT3, and OT4 are turned off, the switches SW2, SW4, SW6, and SW8 disposed between the common buffer AMP_P and the output terminals OT1, OT2, OT3, and OT4 may be turned on.

The common buffer AMP_P may provide the bias voltage Vbs to the output terminals OT1, OT2, OT3, and OT4. The bias voltage Vbs may determine an on-bias value of the first transistor T1 (or the driving transistor), e.g., see FIG. 5. According to an embodiment, the bias voltage Vbs may be a voltage corresponding to a black grayscale. For example, the bias voltage Vbs may have a voltage level of about 5 V to about 7 V. However, the bias voltage Vbs is not limited thereto. In one embodiment, the bias voltage Vbs may correspond to a white grayscale value. For example, the bias voltage Vbs may have a voltage level of about 3 V to about 4 V.

Figure 8:
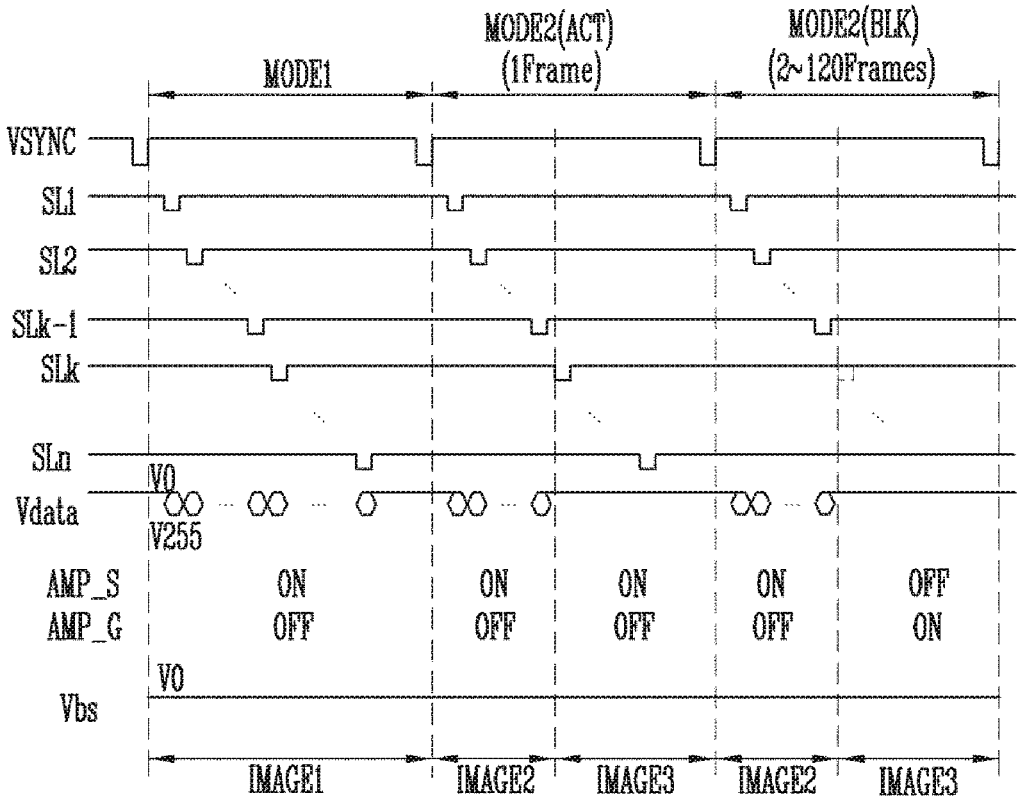
FIG. 8 illustrate an example waveform for controlling a display device.

FIG. 8 is a waveform diagram for explaining operation of the display device of FIG. 1 according to an embodiment.

Referring to FIGS. 3, 7, and 8, waveforms for the following are shown: a vertical synchronization signal VSYNC, a scan signal (for example, GW[i], GC[i], GI[i], or GB[i]) applied to the scan line SL1 connected to the first pixel row to the scan line SLn connected to the n-th pixel row, the data voltage Vdata, on-off operations of a source buffer AMP_S and the common buffer AMP_G, and the bias voltage Vbs. The vertical synchronization signal VSYNC may be included in the synchronization signal Sync and may define the start of a frame section.

When the display device 1000 operates in the first mode MODE1, the scan signal (for example, GW[i], GC[i], GI[i], or GB[i]) having a low level pulse may be sequentially applied to the scan line SL1 connected to the first pixel row to the scan line SLn connected to the n-th pixel row. Also, the data voltage Vdata having an effective value (for example, a voltage level corresponding to various grayscale values other than a black grayscale value) may be applied to the data lines. In this case, the switches SW1, SW3, SW5, and SW7 disposed between the source buffers AMP_S1, AMP_S2, AMP_S3, and AMP_S4 and the output terminals OT1, OT2, OT3, and OT4 may be turned on, and the switches SW2, SW4, SW6, and SW8 disposed between the common buffer AMP_P and the output terminals OT1, OT2, OT3, and OT4 may be turned off. Accordingly, the first image IMAGE1 may be normally displayed in the entire (or a portion of an) area (e.g., the first and second display areas DA1 and DA2) of the display panel 100.

When the display device 1000 operates in the second mode MODE2, the second mode MODE2 may include one active frame ACT and a plurality of blank frames BLK. The active frame ACT may correspond to a period in which the data voltage Vdata for displaying the second image IMAGE2 in the first display area DA1 is applied and a reference voltage (e.g., a voltage level corresponding to the black grayscale value) for displaying the third image IMAGE3 in the second area DA2 is written. A blank frame BLK may correspond to a period in which the reference voltage written in the second display area DA2 in the active frame ACT is maintained and the bias voltage is applied to the pixel PX.

When the display device 1000 corresponds to the active frame ACT of the second mode MODE2, the scan signal (for example, GW[i], GC[i], GI[i], or GB[i]) having the low level pulse may be sequentially applied to the scan line SL1 connected to the first pixel row to the scan line SLn connected to the n-th pixel row. Also, the data voltage Vdata having an effective value corresponding to the scan line SL1 connected to the first pixel row to a scan line SLk−1 connected to the (k−1)th pixel row may be applied to the data lines, and the data voltage Vdata having the reference voltage (for example, the voltage level corresponding to the black grayscale value) corresponding to the scan line SLk which is connected to the k-th pixel row to the scan line SLn connected to the n-th pixel row may be applied to the data lines. In this case, the switches SW1, SW3, SW5, and SW7 disposed between the source buffers AMP_S1, AMP_S2, AMP_S3, and AMP_S4 and the output terminals OT1, OT2, OT3, and OT4 may be turned on, and the switches SW2, SW4, SW6, and SW8 disposed between the common buffer AMP_P and the output terminals OT1, OT2, OT3, and OT4 may be turned off. Accordingly, the first display area DA1 may display the second image IMAGE2 (for example, the moving image), and the second display area DA2 may display the third image IMAGE3 (for example, the black image).

Also, when the display device 1000 corresponds to the blank frames BLK of the second mode MODE2, the scan signal (for example, GW[i], GC[i], GI[i], or CB[i]) having the low level pulse may be sequentially applied only to the scan line SL1 connected to the first pixel row to the scan line SLk−1 connected to the (k−1)th pixel row, and the data voltage Vdata having an effective value corresponding to the scan line SL1 connected to the first pixel row to the scan line SLk−1 connected to the (k−1)th pixel rows may be applied to the data lines. Accordingly, the first display area DA1 may display the second image IMAGE2. In this case, the switches SW1, SW3, SW5, and SW7 disposed between the source buffers AMP_S1, AMP_S2, AMP_S3, and AMP_S4 and the output terminals OT1, OT2, OT3, and OT4 may be turned on, and the switches SW2, SW4, SW6, and SW8 disposed between the common buffer AMP_P and the output terminals OT1, OT2, OT3, and OT4 may be turned off.

When the display device 1000 corresponds to the blank frames BLK of the second mode MODE2, the second scan signal GC[i], the third scan signal GI[i], and the fourth scan signal GB[i] except for the first scan signal GW[i] may not be applied to the scan line SLk connected to the k-th pixel row to the scan line SLn connected to the n-th pixel row. In this case, the switches SW1, SW3, SW5, and SW7 disposed between the source buffers AMP_S1, AMP_S2, AMP_S3, and AMP_S4 and the output terminals OT1, OT2, OT3, and OT4 may be turned off, and the switches SW2, SW4, SW6, and SW8 disposed between the common buffer AMP_P and the output terminals OT1, OT2, OT3, and OT4 may be turned on. Accordingly, when the first scan signal GW[i] is applied to the second transistor T2 (e.g., see FIG. 5), the bias voltage Vbs instead of the data voltage Vdata may be applied to the data lines.

For example, in the first mode MODE1, the driving frequency in the first display area DA1 and the second display area DA2 of the display device 1000 may be 120 Hz. In the first mode MODE1, the first image IMAGE1 of a first frame to a 120th frame may be displayed in the first display area DA1 and the second display area DA2 of the display device 1000 for 1 second. When a basic driving frequency is 120 Hz and a blank frame BLK frequency is 1 Hz in the second mode MODE2, the second image IMAGE2 may be displayed in the first frame to the 120th frame in the first display area DA1 of the display device 1000 for 1 second, and the third image IMAGE3 may be displayed only in the first frame in the second display area DA2 and maintained in the remaining frames. Thus, for example, in the second mode MODE2, the second image IMAGE2 corresponding to the 120th frame may be displayed in the first display area DA1 for 1 second and the third image IMAGE3 corresponding to one frame may be displayed in the second display area DA2.

Since an image is not displayed in the second display area DA2 in the blank frame BLK of the second mode MODE2, power consumption can be reduced. In addition, in the second mode MODE2, since the image is displayed at 120 Hz (e.g., substantially the same as the driving frequency in the first display area DA1), power consumption can be reduced while reducing or minimizing deterioration in display quality of the display device 1000. In one embodiment, the first and second images IMAGE1 and IMAGE2 may be moving images and the third image IMAGE3 may be the still image.

Figure 9:
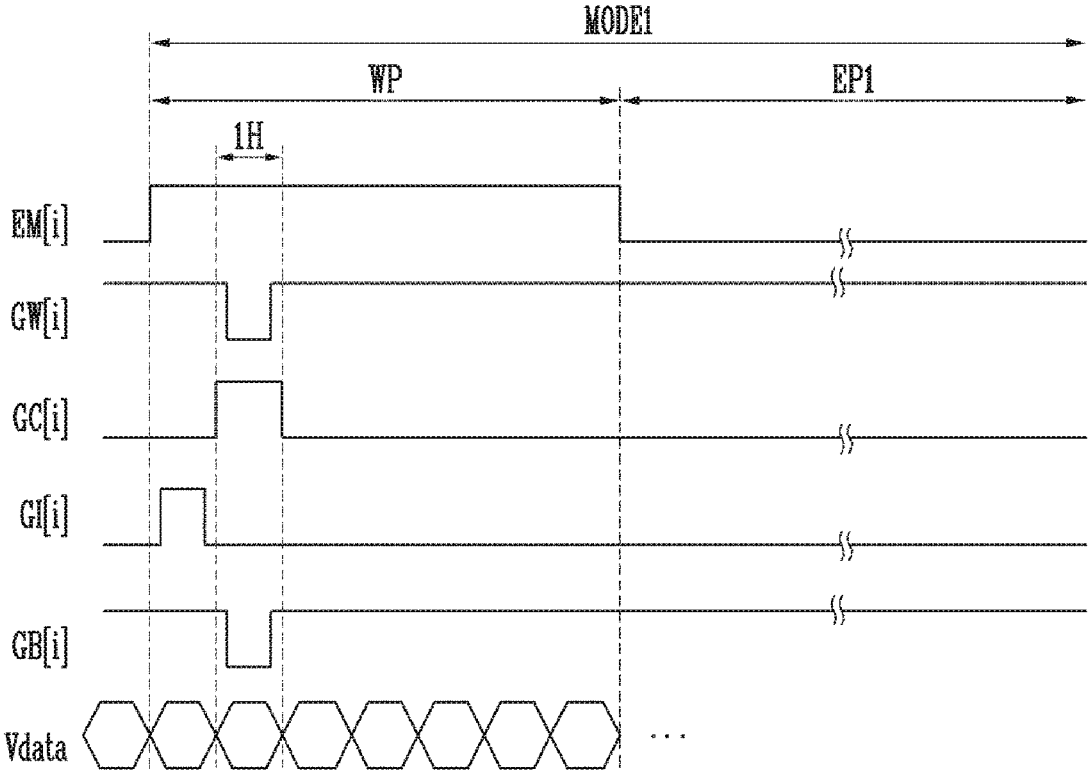
FIG. 9 illustrates waveforms for a first mode of operation according to an embodiment.
Figure 10A:
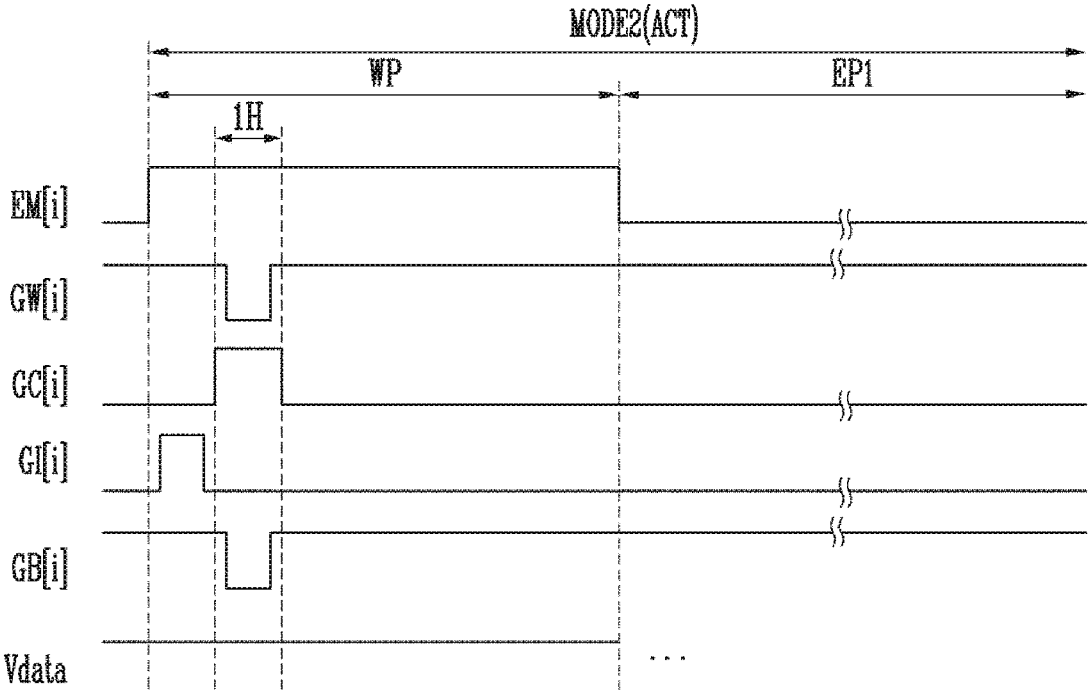
FIG. 10A illustrates waveforms for an active frame corresponding to a second mode of operation of a display device according to an embodiment.
Figure 10B:
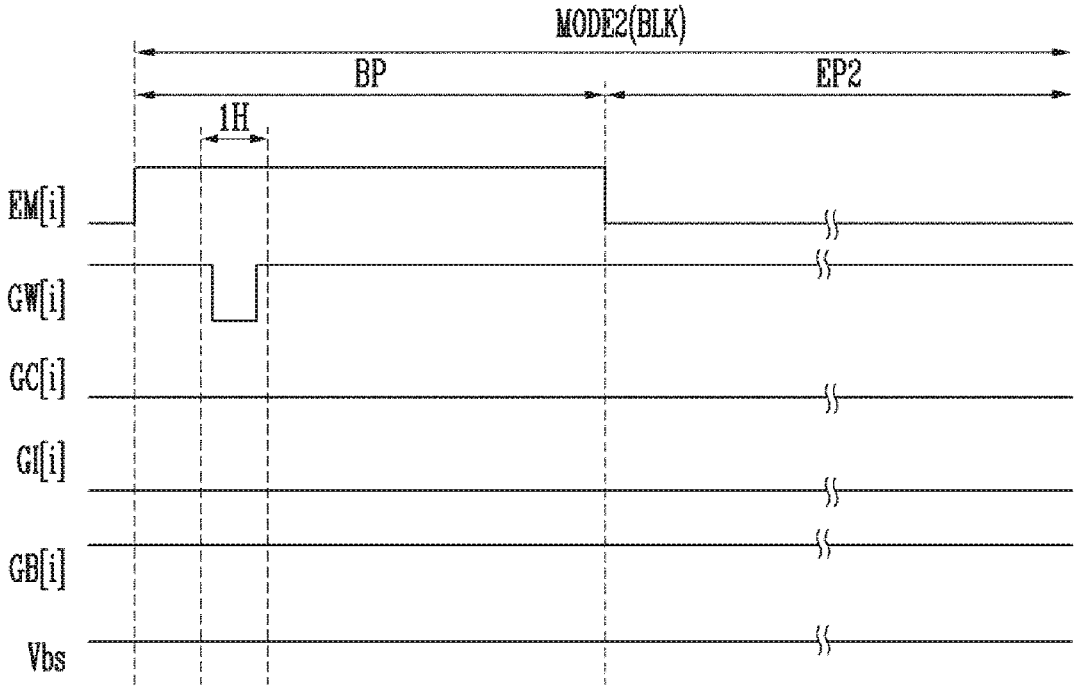
FIG. 10B illustrates waveforms for a blank frame corresponding to the second mode of operation.

FIG. 9 is a waveform diagram illustrating an embodiment of operation in a first mode. FIG. 10A is a waveform diagram illustrating an embodiment of operation in an active frame of the second mode. FIG. 10B is a waveform diagram illustrating an embodiment of operation in a blank frame of the second mode.

Referring to FIGS. 5, 8, and 9, the scan signals GW[i], GC[i], GI[i], and GB[i] supplied in the first mode MODE1 and operation of the pixel PX will be described in detail. In this case, the pixel PX may receive the emission control signal EM[i] through an emission control line Ei during a data writing period WP.

According to an embodiment, in the first mode MODE1, while the emission control signal EM[i] is provided and after the third scan signal GI[i] is supplied, the first scan signal GW[i], the second scan signal GC[i], and the fourth scan signal GB[i] may be supplied to overlap.

First, when the third scan signal GI[i] is supplied during the data writing period WP, the fourth transistor T4 may be turned on to initialize the gate electrode of the first transistor T1.

Thereafter, when the first scan signal GW[i] is supplied, the second transistor T2 may be turned on and the data voltage Vdata may be supplied from the data line DLj to the first electrode (or source electrode) of the first transistor T1.

In addition, the data voltage Vdata may be supplied to the pixel PX in synchronization with the first scan signal GW[i] and the second scan signal GC[i]. The data voltage Vdata may be stored in the storage capacitor Cst. The pixel PX may emit light with a grayscale value corresponding to the data voltage Vdata stored in the storage capacitor Cst during a first emission period EP1. Accordingly, the first image IMAGE1 may be normally displayed in the entire (or a portion of an) area of the display panel 100 (e.g., the first and second display areas DA1 and DA2, see FIG. 3).

When the fourth scan signal GB[i] is supplied, the seventh transistor T7 may be turned on and the voltage of the second initialization power source VINT2 may be provided to the anode electrode of the light emitting element LD. Accordingly, any parasitic capacitance that may be generated in the light emitting element LD is discharged, so that expression of the black grayscale value can be improved.

Referring to FIGS. 5, 8, 9, and 10A, in the active frame ACT of the second mode MODE2, a period in which the scan signals GW[i], GC[i], GI[i], and GB[i] are supplied to the scan line SL1 connected to the first pixel row to the scan line SLk−1 connected to the (k−1)th pixel row may be substantially the same as the operation of the pixel PX in the first mode MODE1 shown in FIG. 9.

In addition, a period in which the scan signals GW[i], GC[i], GI[i], and GB[i] are supplied to the scan line SLk connected to the k-th pixel row to the scan line SLn connected to the n-th pixel row may be different from the operation of the pixel PX in the first mode MODE1 shown in FIG. 9 only in that: the data voltage Vdata corresponding to the scan signal does not have the effective value (for example, the voltage level corresponding to various grayscale values other than the black grayscale value) but has the reference voltage (e.g., the voltage level corresponding to the black grayscale value). Therefore, duplicate descriptions will be omitted. Accordingly, in the active frame ACT of the second mode MODE2, the first display area DA1 may display the second image IMAGE2 (for example, the moving image), and the second display area DA2 may display the third image IMAGE3 (for example, the black image).

Referring to FIGS. 5, 8, and 10B, the blank frame BLK of the second mode MODE2 may include a bias period BP and a second emission period EP2. The bias period BP may correspond to a non-emission period. In this case, the pixel PX may receive the emission control signal EM[i] through the emission control line Ei during the bias period BP.

In the bias period BP, only the first scan signal GW[i] may be supplied, and the second scan signal GC[i], the third scan signal GI[i], and the fourth scan signal GB[i] may not be supplied. For example, the second scan signal GC[i], the third scan signal GI[i], and the fourth scan signal GB[i] may have a logic low level. Since only the second transistor T2 is turned on in the bias period BP and a predetermined voltage is applied to the source electrode of the first transistor T1, the bias period BP may be referred to as a period in which on-bias state of the first transistor T1 is maintained. Accordingly, the active frame ACT may be understood serve as a writing period, and the blank frame BLK may be understood serve as a holding period.

While the emission control signal EM[i] of the blank frame BLK is provided, the bias voltage Vbs may be supplied to the data line DLj (see FIG. 5). The bias voltage Vbs may determine the on-bias value of the first transistor T1. For example, when the first scan signal GW[i] is supplied, the bias voltage Vbs may be supplied to the source electrode of the first transistor T1 (that is, the first node N1). According to an embodiment, the bias voltage Vbs may be a voltage corresponding to the black grayscale value. For example, the bias voltage Vbs may be about 5 V to about 7 V.

Figure 11A:
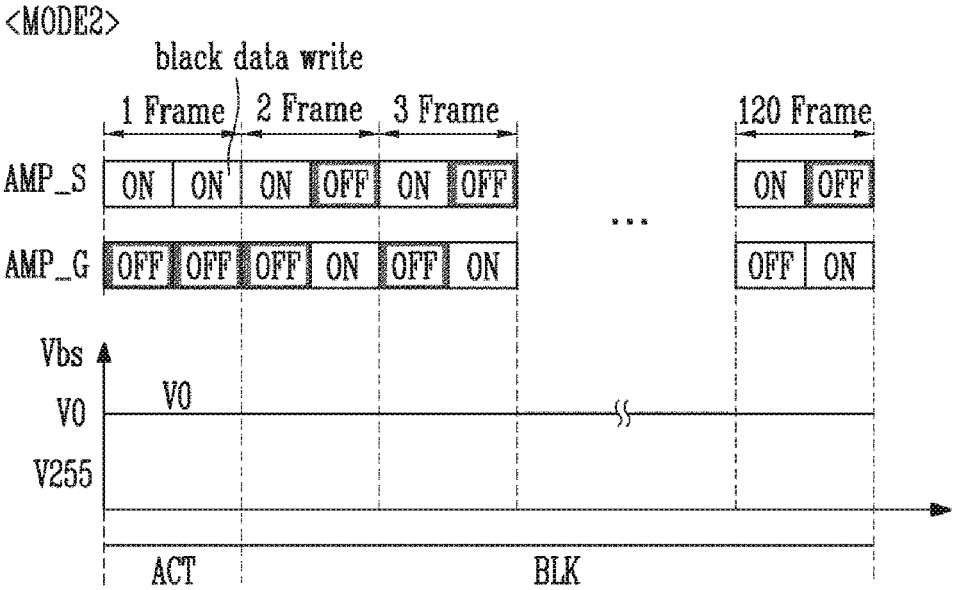
FIGS. 11A and 11B illustrate examples for explaining a problem that may occur during operation of the display device illustrated in FIG. 8.
Figure 11B:
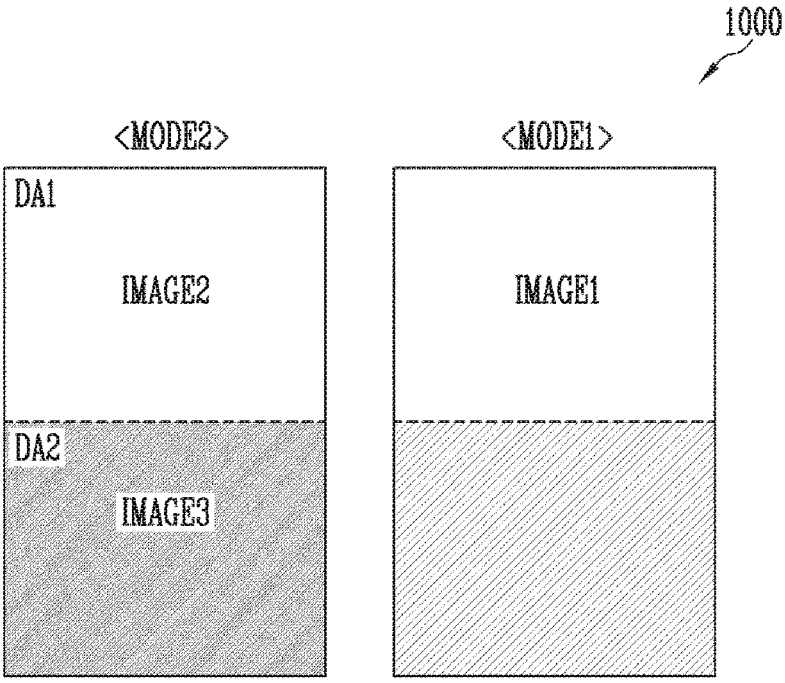

FIGS. 11A and 11B are diagrams for explaining a problem that may occur in the operation of the display device illustrated in FIG. 8. In this case, for convenience of explanation, FIG. 11A shows only on-off state of source buffers AMP_S and common buffers AMP_G and the level of the bias voltage Vbs in the second mode MODE2 shown in the waveform diagram of FIG. 8.

Referring to FIGS. 5, 7, 11A, and 11B, since the source buffer AMP_S is turned off and the common buffer AMP_G is turned on in each of the blank frames BLK of the second mode MODE2, the display device 1000 may provide the bias voltage Vbs to the data line DLj. Accordingly, the bias voltage Vbs may be provided to the source electrode (or the first node N1) of first transistors T1 included in the second display area DA2. As a result, hysteresis of the first transistor T1 may be reduced. When the hysteresis is reduced, response speed according to the increase or decrease of the data voltage may be improved, and thus the grayscale value may be accurately expressed.

However, according to the embodiment shown in FIG. 11A, the bias voltage Vbs may have a first bias voltage (for example, a voltage VO corresponding to the black grayscale value) that is a fixed voltage level during all or a portion of the blank frames BLK. As such, when the bias voltage Vbs of substantially the same level is continuously applied to the source electrode of the first transistor T1, the characteristic curve (or threshold voltage) of the first transistor T1 may be shifted, and this shift phenomenon may be strengthened. Due to the shifted threshold voltage, the pixel PX may be displayed with a grayscale value different from a desired grayscale value. For example, as shown in FIG. 11B, when the display device 1000 operates in the second mode MODE2 for a long time (e.g., longer than a predetermined time), a deviation in threshold voltage may occur between first transistors T1 included in each of the first display area DA1 displaying the second image IMAGE2 (for example, the moving image) and the second display area DA2 displaying the third image IMAGE3 (for example, the black image). As a result, when the display device 1000 operates in the first mode MODE1 again, light of different grayscales values may be expressed, even when the data voltage Vdata of substantially the same grayscale value is applied to the first display area DA1 and the second display area DA2 displaying the first image IMAGE1. As a result, a difference in luminance (or an afterimage) between the first display area DA1 and the second display area DA2 may occur.

Figure 12A:
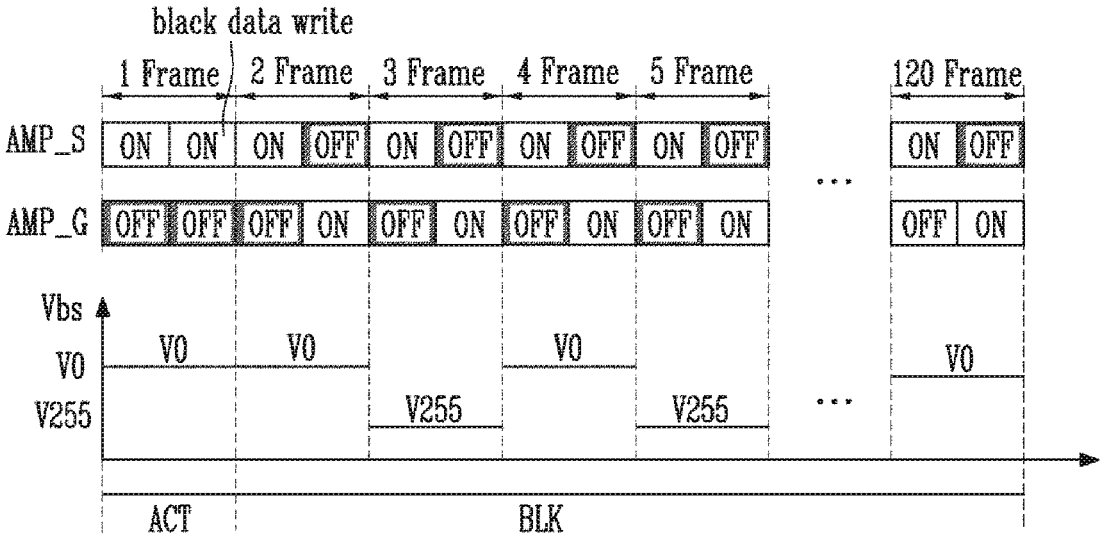
FIGS. 12A and 12B illustrate operation and effects of an embodiment of a display device.
Figure 12B:
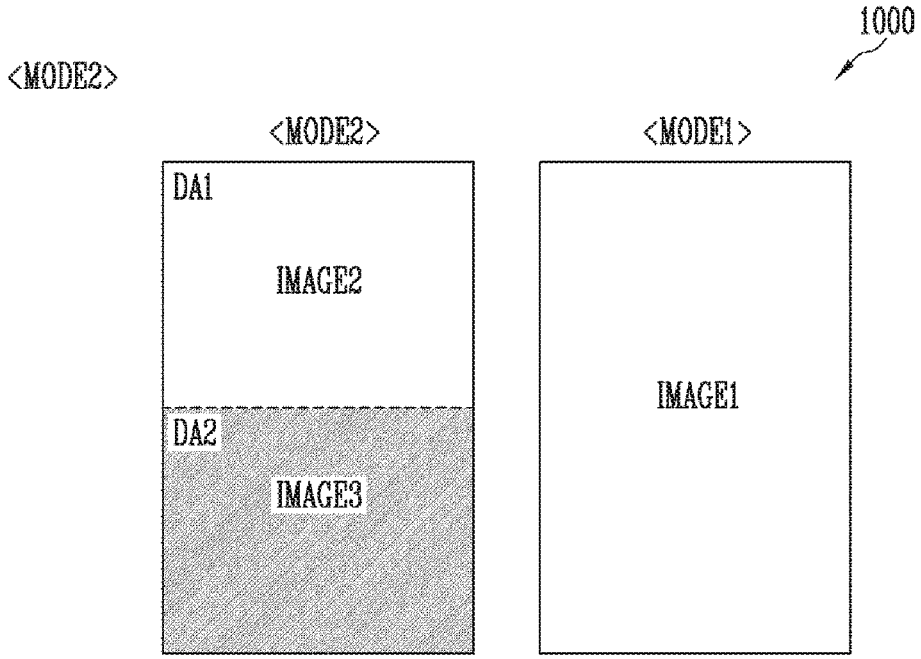

FIGS. 12A and 12B are diagrams for explaining operation and effects of a display device according to an embodiment.

Referring to FIGS. 12A and 12B, in the embodiment shown in FIGS. 11A and 11B, the bias voltage Vbs may have the first bias voltage fixed in all or a portion of blank frames BLK. However, the embodiment shown in FIG. 12A is different in that the bias voltage Vbs may toggle (or swing) to the first bias voltage (for example, the voltage VO corresponding to the black grayscale value) and a second bias voltage (for example, a voltage V255 corresponding to the white grayscale value) for each blank frame BLK. Therefore, duplicate descriptions will be omitted, and differences will be mainly described.

According to the embodiment shown in FIG. 12A, in the active frame ACT, the common buffer AMP_G may be turned off and the bias voltage Vbs may not be applied. Thereafter, in a first blank frame BLK (for example, 2 Frame), the bias voltage Vbs having the first bias voltage (for example, the voltage VO corresponding to the black grayscale value) may be applied to the source electrode of the first transistor T1. In a second blank frame BLK (for example, 3 Frame), the bias voltage Vbs having the second bias voltage (for example, the voltage V255 corresponding to the white grayscale) may be applied to the source electrode of the first transistor T1. Thereafter, in the blank frame BLK (that is, 3 to 120 Frames), similarly the first bias voltage (for example, the voltage VO corresponding to the black grayscale value) and the second bias voltage (for example, the voltage V255 corresponding to the white grayscale value) may be alternately applied to the source electrode of the first transistor T1 for each frame.

As described above, when the first bias voltage (for example, the voltage VO corresponding to the black grayscale value) and the second bias voltage (for example, the voltage V255 corresponding to the white grayscale value) are alternately applied to the source electrode of the first transistor T1 for each frame, the characteristic curve (or threshold voltage) of the first transistor T1 may not be shifted in one direction. Also, the characteristic curve of the first transistor T1 may be reset to a constant state by being repeatedly shifted in opposite direction in response to the first bias voltage and the second bias voltage. Thus, the first transistor T1 included in each of the pixels PX (e.g., see FIG. 5) included in the second display area DA2 may be initialized to a state in which light of a halftone is expressed.

As shown in FIG. 12B, even when the display device 1000 operates in the second mode MODE2 for a long time (e.g., longer than a predetermined value), the deviation in threshold voltage between the first transistors T1 included in each of the first display area DA1 displaying the second image IMAGE2 (for example, the moving image) and the second display area DA2 displaying the third image IMAGES (for example, the black image) can be reduced or minimized. As a result, when the display device 1000 operates in the first mode MODE1 again, light of substantially the same grayscale value may be expressed when the data voltage Vdata of substantially the same grayscale value is applied to the first display area DA1 and the second display area DA2 displaying the first image IMAGE1. As a result, the difference in luminance (or afterimage) between the first display area DA1 and the second display area DA2 may not occur or may be substantially reduced.

Hereinafter, other embodiments will be described. In the following embodiments, descriptions of the components as those of the previously described embodiments will be omitted or simplified, and differences will be mainly described.

Figure 13:
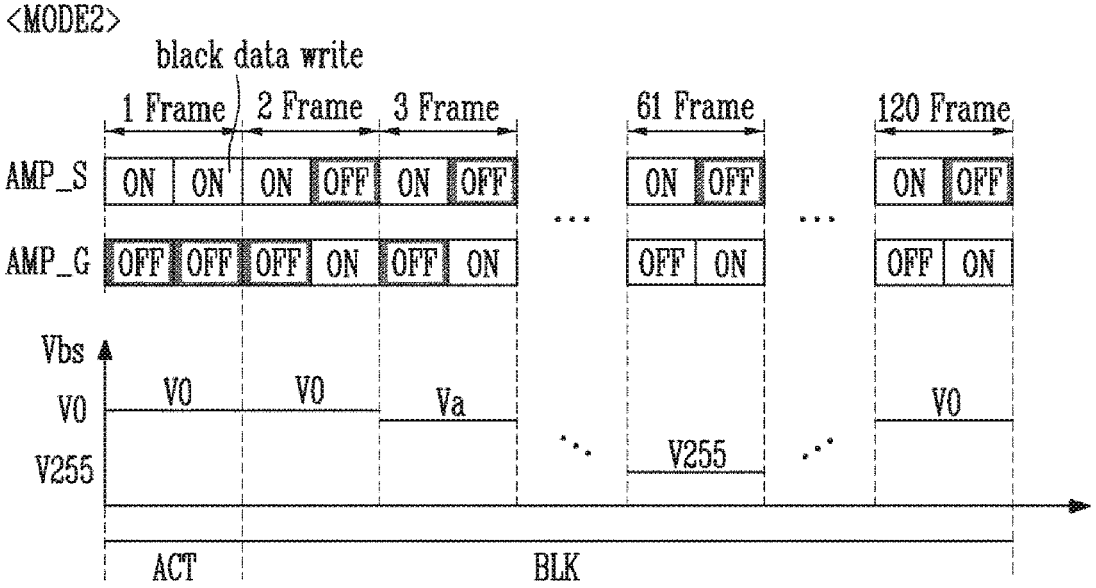
FIG. 13 illustrate operation and effects of an embodiment of a display device.

FIG. 13 is a diagram for explaining operation and effects of a display device according to an embodiment.

Referring to FIG. 13, in the embodiment shown in FIGS. 12A and 12B, the bias voltage Vbs may be toggled (or swinged) to the first bias voltage and the second bias voltage for each blank frame BLK. However, the embodiment shown in FIG. 13 is different in that the bias voltage Vbs may be gradually reduced from the first bias voltage (for example, the voltage VO corresponding to the black grayscale value) to the second bias voltage (for example, the voltage V255 corresponding to the white grayscale value) from the first blank frame BLK (for example, 2 Frame) to a specific blank frame BLK (for example, 61 Frame), and may be gradually increased from the second bias voltage to the first bias voltage from the specific blank frame BLK (for example, 61 Frame) to the last blank frame BLK (for example, 120 Frame).

The timing controller 600 (or the data driver 400) may calculate a difference in bias voltage Vbs between adjacent blank frames BLK corresponding to the number of frames of the blank frame BLK. According to an embodiment, the timing controller 600 (or the data driver 400) may calculate the difference in bias voltage Vbs between the adjacent blank frames BLK. This may be accomplished, for example, by dividing a voltage difference between the voltage VO corresponding to the black grayscale value and the voltage V255 corresponding to the white grayscale value by a half value of the number of frames of the blank frame BLK. Accordingly, a third bias voltage Va of the second blank frame BLK (for example, 3 Frame) may have a voltage V4 corresponding to 4 grayscale values by reflecting a voltage difference (a voltage corresponding to about 4 grayscale values) between the adjacent blank frames BLK from the bias voltage VO of the first blank frame BLK (for example, 2 Frame).

However, the modified embodiment of the bias voltage Vbs in the second mode MODE2 is an example, and the present invention is not limited thereto. For example, in one embodiment the bias voltage Vbs in the second mode MODE2 may have a plurality of sections that gradually increase or decrease during the first blank frame BLK (for example, 2 Frame) to the last blank frame BLK (for example, 120 Frame).

For this reason, substantially the same effect as the embodiment shown in FIGS. 12A and 12B can be expected. Furthermore, occurrence of a flicker phenomenon, caused by a sudden change between the voltage VO corresponding to the black grayscale value and the voltage V255 corresponding to the white grayscale value, can be reduced or further prevented.

Figure 14:
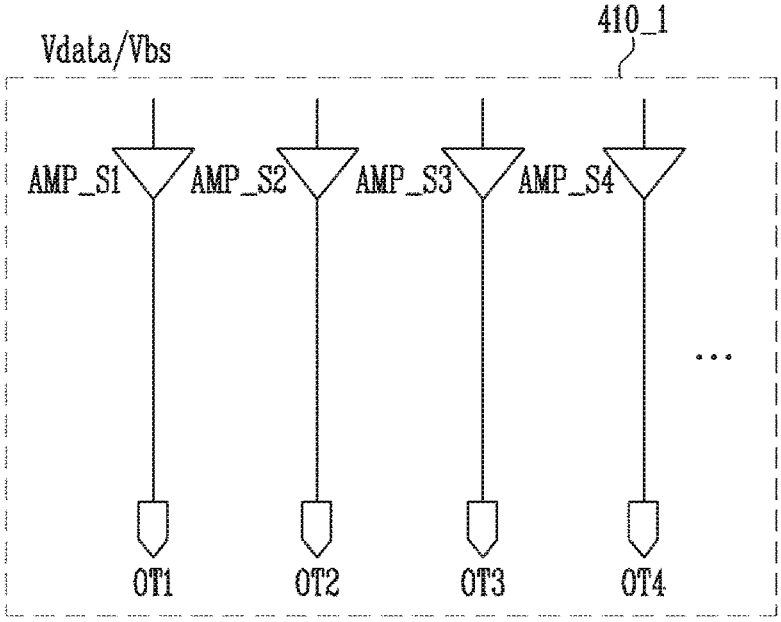
FIGS. 14 to 16 illustrate waveforms for applying a bias voltage using a source buffer according to one embodiment.
Figure 15:
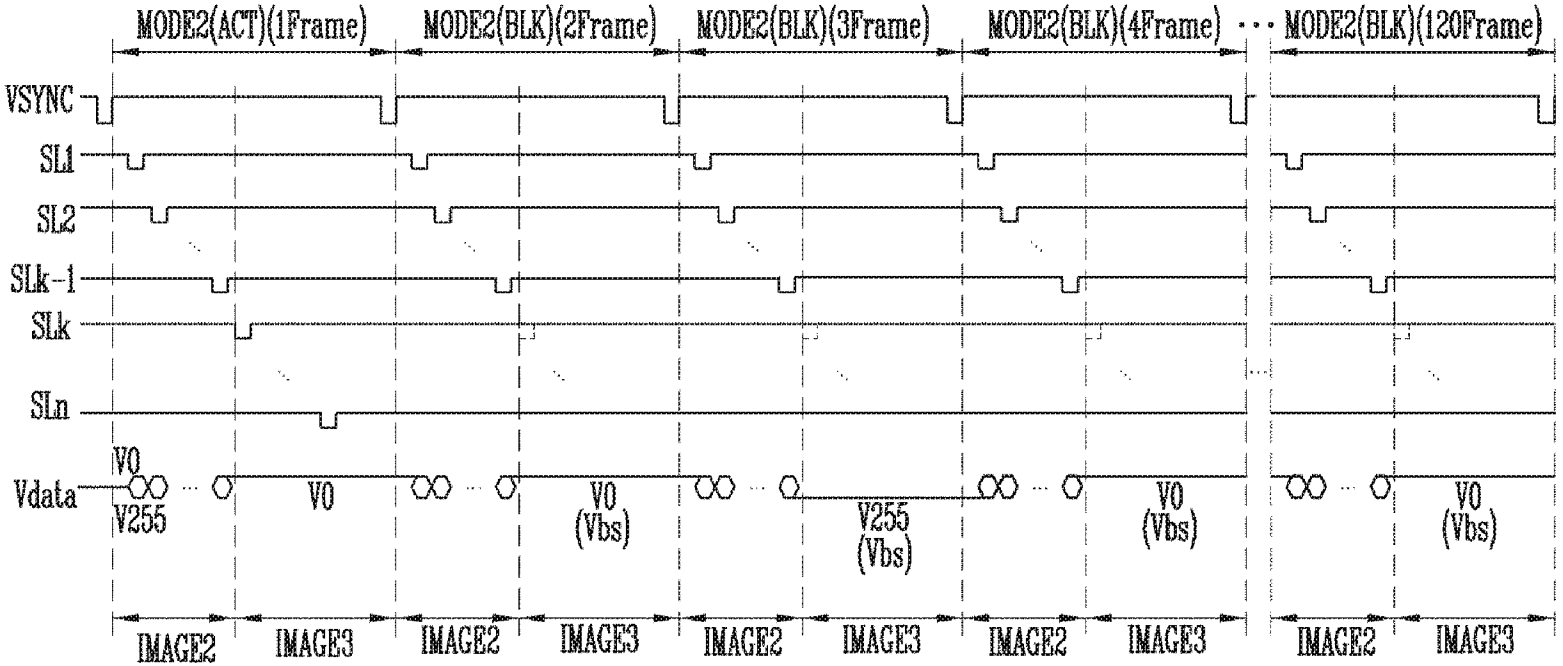
Figure 16:
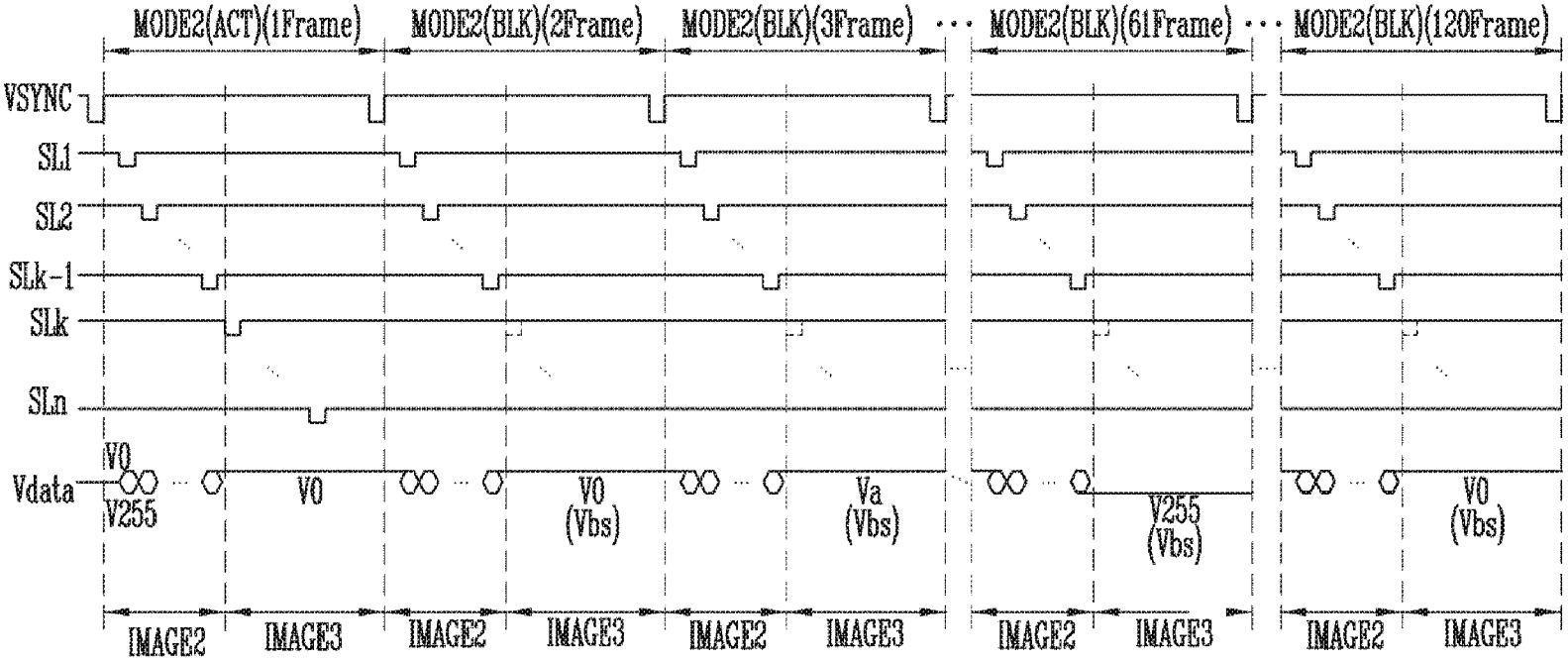

FIGS. 14 to 16 are diagrams for explaining an embodiment of applying a bias voltage using a source buffer. In this case, FIG. 14 is a circuit diagram illustrating another example of the output buffer included in the data driver of FIG. 1. FIG. 15 is a waveform diagram corresponding to the operation of the display device shown in FIG. 12A, and FIG. 16 is a waveform diagram corresponding to the operation of the display device shown in FIG. 13.

Referring to FIGS. 1 and 14, the data driver 400 may include an output buffer 410_1. Unlike the embodiment shown in FIG. 7, since the common buffer AMP_G is not included, the output buffer 410_1 may not include the switches SW1 to SW8 for selectively selecting the voltage output from each of the source buffers AMP_S1, AMP_S2, AMP_S3, and AMP_S4 and the common buffer AMP_G.

The first source buffer AMP_S1 may be connected to the first output terminal OT1 and, for example, the first output terminal OT1 may be connected to the first data line DLL The second source buffer AMP_S2 may be connected to the second output terminal OT1 and, for example, the second output terminal OT2 may be connected to the second data line DL2. The third source buffer AMP_S3 may be connected to the third output terminal OT3 and, for example, the third output terminal OT3 may be connected to the third data line DL3. The fourth source buffer AMP_S4 may be connected to the fourth output terminal OT4 and, for example, the fourth output terminal OT4 may be connected to the fourth data line DL4.

Referring to FIGS. 12A, 14, and 15, in the embodiment shown in FIG. 12A, the source buffer AMP_S may provide the data voltage Vdata to the pixel PX (see FIG. 5) and the common buffer AMP_G may provide the bias voltage Vbs. However, the embodiment shown in FIG. 15 is different in that the source buffer AMP_S may provide the data voltage Vdata and the data voltage Vdata as the bias voltage Vbs to the pixel PX (e.g., see FIG. 5) through time division. Therefore, duplicate descriptions will be omitted, and differences will be mainly described.

According to one embodiment, the display device 1000 (e.g., see FIG. 1) may provide the data voltage Vdata, provided during a period in which the third image IMAGE3 is displayed in the blank frame BLK of the second mode MODE2, as the bias voltage Vbs to the pixel PX (or the first electrode of the first transistor T1 (e.g., see FIG. 5). Thus, in one embodiment the display device 1000 may time-divide the data voltage Vdata and use it as the bias voltage Vbs.

As a result, the bias voltage Vbs may have the first bias voltage (for example, the voltage VO corresponding to the black grayscale value) in the first blank frame BLK (for example, 2 Frame). The bias voltage Vbs may have the second bias voltage (for example, the voltage V255 corresponding to the white grayscale value) in the second blank frame BLK (for example, 3 Frame). The bias voltage Vbs may have the first bias voltage (for example, the voltage VO corresponding to the black grayscale value) in the third blank frame BLK (for example, 4 Frame). The bias voltage Vbs may have the first bias voltage (for example, the voltage VO corresponding to the black grayscale value) in the last blank frame BLK (for example, 120 Frame).

As in the embodiment shown in FIG. 12A, the bias voltage Vbs having the first bias voltage (for example, the voltage VO corresponding to the black grayscale value) may be applied to the source electrode of the first transistor T1 in the first blank frame BLK (e.g., 2 Frame), and the bias voltage Vbs having the second bias voltage (for example, the voltage V255 corresponding to the white grayscale value) may be applied to the source electrode of the first transistor T1 in the second blank frame BLK (that is, 3 Frame). Thereafter, similarly, the first bias voltage (for example, the voltage VO corresponding to the black grayscale value) and the second bias voltage (for example, the voltage V255 corresponding to the white grayscale value) may be alternately applied to the source electrode of the first transistor T1 for each frame in the blank frame BLK (that is, 3 to 120 Frames).

For this reason, the common buffer AMP_G is not provided and substantially the same effect as the embodiment shown in FIGS. 12A and 12B can be simply expected.

Referring to FIGS. 13 and 16, in the embodiment shown in FIG. 13, the source buffer AMP_S may provide the data voltage Vdata to the pixel PX and the common buffer AMP_G may provide the bias voltage Vbs to the pixel PX (e.g., see FIG. 5). However, the embodiment shown in FIG. 16 is different in that the source buffer AMP_S may provide the data voltage Vdata and the data voltage Vdata as the bias voltage Vbs to the pixel PX (e.g., see FIG. 5) through the time division. Therefore, duplicate descriptions will be omitted and differences will be mainly described.

According to an embodiment, the display device 1000 (e.g., see FIG. 1) may provide the data voltage Vdata, provided during a period in which the third image IMAGE3 is displayed in the blank frame BLK of the second mode MODE2, as the bias voltage Vbs to the pixel PX (or the first electrode of the first transistor T1, e.g., see FIG. 5). Thus, in this embodiment the display device 1000 may time-divide the data voltage Vdata and use it as the bias voltage Vbs.

As a result, the bias voltage Vbs may have the first bias voltage (for example, the voltage VO corresponding to the black grayscale value) in the first blank frame BLK (for example, 2 Frame). The bias voltage Vbs may have the third bias voltage (for example, the voltage V4 corresponding to the 4 grayscale values) in the second blank frame BLK (for example, 3 Frame). The bias voltage Vbs may have the second bias voltage (for example, the voltage V255 corresponding to the white grayscale value) in the specific blank frame BLK (for example, 61 Frame). The bias voltage Vbs may have the first bias voltage (for example, the voltage VO corresponding to the black grayscale value) in the last blank frame BLK (for example, 120 Frame).

In this case, similarly to the embodiment shown in FIG. 13, the difference in bias voltage Vbs (or data voltage Vdata) between the adjacent blank frames BLK may be changed to correspond to the number of frames of the blank frame BLK. According to an embodiment, the difference in bias voltage Vbs between the adjacent blank frames BLK may be calculated by dividing the voltage difference between the voltage VO corresponding to the black grayscale value and the voltage V255 corresponding to the white grayscale value by the half value of the number of frames of the blank frame BLK. For example, the third bias voltage Va of the second blank frame BLK (for example, 3 Frame) may have the voltage V4 corresponding to 4 grayscale values by reflecting the voltage difference (the voltage corresponding to about 4 grayscale values) between the adjacent blank frames BLK from the bias voltage VO of the first blank frame BLK (for example, 2 Frame).

For this reason, the common buffer AMP_G is not provided and substantially the same effect as the embodiment shown in FIG. 13 can be simply attained.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, devices, modules, units, multiplexers, determiners, switches, generators, logic, interfaces, decoders, drivers, and other signal generating and signal processing features of the embodiments disclosed herein may be implemented, for example, in non-transitory logic that may include hardware, software, or both. When implemented at least partially in hardware, the controllers, processors, devices, modules, units, multiplexers, generators, logic, interfaces, decoders, drivers, determiners, switches and other signal generating and signal processing features may be, for example, any of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, multiplexers, generators, logic, interfaces, decoders, drivers, determiners, switches and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, a display device may be provided which reduces or prevents afterimage from occurring in an area where a black still image is displayed on the display panel. This may be accomplished, for example, by changing the bias voltage applied to the driving transistor at a predetermined cycle without fixing it.

Effects of the present invention are not limited to the above-described effects, and effects that are not mentioned may be clearly understood by those skilled in the art from the present specification and the accompanying drawings. The above-described descriptions are merely illustrative of the technical spirit of the present embodiments. Those skilled in the art will appreciate that various modifications and changes can be made to these embodiments without departing from the spirit and scope of the description herein. Accordingly, the embodiments described above may be implemented separately or in combination with each other.

Accordingly, the embodiments disclosed in the present specification are not intended to be limiting but rather are intended to explain the technical spirit. The scope of protection of the present embodiments should be interpreted by the appended claims, and technical spirits within the scope equivalent thereto should be construed as being included in the scope of the embodiments. The embodiments may be combined to form additional embodiments.

What is claimed is:

1. A display device, comprising:

a display panel including pixels connected to data lines and scan lines, respectively, and including a first display area and a second display area adjacent to the first display area;

a data driver configured to provide a data voltage and a bias voltage to each of the data lines;

a scan driver configured to provide a scan signal to the scan lines; and a timing controller configured to receive input image data and a control signal and control the data driver and the scan driver according to at least two operation modes, wherein:

the at least two operation modes include a first mode to drive the first display area and the second display area at a normal frequency, and a second mode to drive the first display area at a first frequency substantially equal to or lower than the normal frequency and to drive the second display area at a second frequency lower than the first frequency, the second mode includes an active frame to write a reference voltage to display a black image in the second display area, and blank frames to maintain the reference voltage and apply the bias voltage to the pixels included in the second display area, and the data driver is configured to vary and provide the bias voltage in the blank frames.

2. The display device of claim 1, wherein:

the data driver includes an output buffer, and the output buffer includes a plurality of buffers configured to provide the data voltage to each of the data lines.

3. The display device of claim 2, wherein the output buffer is configured to provide the data voltage to one of the data lines in the active frame and to provide the bias voltage to the one of the data lines in the blank frames.

4. The display device of claim 3, wherein the output buffer is configured to alternately apply a first bias voltage and a second bias voltage different from the first bias voltage for each of the blank frames.

5. The display device of claim 4, wherein:

the first bias voltage corresponds to a black grayscale value, and the second bias voltage corresponds to a white grayscale value.

6. The display device of claim 2, wherein the data driver includes a single common buffer configured to provide the bias voltage to the data lines.

7. The display device of claim 6, wherein the output buffer and the common buffer are alternatively connected to a common one of the data lines.

8. The display device of claim 6, wherein the common buffer is configured to alternately apply a first bias voltage and a second bias voltage different from the first bias voltage for each of the blank frames.

9. The display device of claim 8, wherein:

the first bias voltage corresponds to a black grayscale value, and the second bias voltage corresponds to a white grayscale value.

10. The display device of claim 6, wherein the common buffer is configured to provide:

a plurality of bias voltages that are reduced from a first bias voltage to a second bias voltage from a first blank frame to a specific blank frame, and a plurality of bias voltages that are increased from the second bias voltage to the first bias voltage from the specific blank frame to a last blank frame.

11. The display device of claim 10, wherein:

the first bias voltage corresponds to a black grayscale value, and the second bias voltage corresponds to a white grayscale value.

12. The display device of claim 10, wherein the timing controller is configured to divide a voltage difference between the first bias voltage and the second bias voltage by a half value of a number of frames of the blank frames, to calculate a voltage difference between adjacent frames among the blank frames.

13. The display device of claim 1, wherein the timing controller includes an area determiner configured to:

perform a difference operation between current frame data and previous frame data using the input image data, determine an area in which a result of the difference operation is substantially equal to or less than a reference value as the second display area, and generate information corresponding to a start line of the second display area.

14. The display device of claim 13, wherein the timing controller includes a clock signal generator configured to generate scan clock signals and mask at least one pulse of the scan clock signals based on the information corresponding to the start line of the second display area.

15. The display device of claim 1, wherein each of the pixels includes:

a light emitting element;

a first transistor including a first electrode and a second electrode, the first electrode connected to a first node coupled to a first driving power source and the second electrode connected to a second node;

a second transistor including a first electrode connected to one of the data lines and a second electrode connected to the first node, the second transistor configured to be turned on in response to a first scan signal;

a third transistor including a first electrode connected to the second node and a second electrode connected to a third node which corresponds to a gate electrode of the first transistor, the third transistor configured to be turned on in response to a second scan signal;

a fourth transistor including a first electrode connected to the third node and a second electrode connected to a first initialization power source, the fourth transistor configured to be turned on in response to a third scan signal;

a fifth transistor including a first electrode connected to the first driving power source and a second electrode connected to the first node, the fifth transistor configured to be turned off in response to an emission control signal;

a sixth transistor including a first electrode connected to the second node and a second electrode connected to a first electrode of the light emitting element, the sixth transistor configured to be turned off in response to the emission control signal; and a seventh transistor including a first electrode connected to the first electrode of the light emitting element and a second electrode connected to a second initialization power source, the seventh transistor configured to be turned on in response to a fourth scan signal.

16. The display device of claim 15, further comprising:

a storage capacitor disposed between the first driving power source and the third node.

17. The display device of claim 16, wherein the one of the data lines is configured to provide the data voltage during the active frame and the bias voltage during the blank frames.

18. The display device of claim 17, wherein the data driver is configured to provide the bias voltage to the first electrode of the first transistor.

19. The display device of claim 18, wherein:

while the emission control signal is provided to the pixel in the active frame of the first mode and the second mode, the scan driver is configured to supply the first scan signal, the second scan signal, and the fourth scan signal to overlap each other after the third scan signal is supplied.

20. The display device of claim 19, wherein in the blank frames of the second mode:

the scan driver is configured to supply the first scan signal and not the second scan signal, the third scan signal, and the fourth scan signal.

* * * * *